US010906713B2

(12) United States Patent
Ophardt et al.

(10) Patent No.: US 10,906,713 B2
(45) Date of Patent: Feb. 2, 2021

(54) NON-REMOVABLE CONTAINER ENCLOSURE

(71) Applicant: OP-Hygiene IP GmbH, Niederbipp (CH)

(72) Inventors: Heiner Ophardt, Arisdorf (CH); Andrew Jones, St. Anns (CA); Zhenchun Shi, Hamilton (CA)

(73) Assignee: OP-Hygiene IP GmbH, Niederbipp (CH)

( * ) Notice: Subject to any disclaimer, the term of this patent is extended or adjusted under 35 U.S.C. 154(b) by 125 days.

(21) Appl. No.: 16/290,078

(22) Filed: Mar. 1, 2019

(65) Prior Publication Data

US 2019/0270561 A1 Sep. 5, 2019

Related U.S. Application Data

(60) Provisional application No. 62/637,787, filed on Mar. 2, 2018.

(51) Int. Cl.

| | |
|---|---|
| ***B65D 55/02*** | (2006.01) |
| ***B65D 41/04*** | (2006.01) |
| ***B65D 50/04*** | (2006.01) |

(52) U.S. Cl.

CPC ..... *B65D 55/022* (2013.01); *B65D 41/0471* (2013.01); *B65D 50/041* (2013.01); *B65D 2255/20* (2013.01)

(58) Field of Classification Search

CPC ..... B65D 55/022; B65D 41/0471; B65D 50/041; B65D 2255/20

See application file for complete search history.

(56) References Cited

U.S. PATENT DOCUMENTS

| | | | | |
|---|---|---|---|---|
| 2,028,490 A | | 1/1936 | Baker | |
| 2,423,582 A | * | 7/1947 | Coleman | 215/252 |
| 3,511,403 A | * | 5/1970 | Braun | B65D 41/0471 215/330 |
| 3,620,400 A | * | 11/1971 | Braun | B65D 41/0471 215/330 |
| 4,007,850 A | * | 2/1977 | Beaugrand | B65D 50/046 215/216 |
| 4,053,077 A | | 10/1977 | DeFelice | |
| 4,084,716 A | | 4/1978 | Bogert | |
| 4,139,112 A | | 2/1979 | Cooke | |
| 4,289,248 A | | 9/1981 | Lynn | |
| 4,320,844 A | | 3/1982 | Cooper | |
| 5,143,237 A | * | 9/1992 | Lindsey | B05B 11/0008 215/216 |
| 5,197,620 A | * | 3/1993 | Gregory | B65D 41/3428 215/307 |
| 5,360,127 A | | 11/1994 | Barriac | |

(Continued)

FOREIGN PATENT DOCUMENTS

EP 2888489 9/2017

OTHER PUBLICATIONS

European Search Report for the instant invention from Global Dossier. dated Aug. 2019. (Year: 2019).*

*Primary Examiner* — James N Smalley

(74) *Attorney, Agent, or Firm* — Thorpe North & Western LLP

(57) ABSTRACT

An improved threaded coupling arrangement for non-removably securing an outer collar member onto an inner tubular member against removal.

20 Claims, 22 Drawing Sheets

(56) References Cited

U.S. PATENT DOCUMENTS

| | | | | |
|---|---|---|---|---|
| 5,685,445 | A * | 11/1997 | Dobbs | B65D 41/0471 215/330 |
| 5,975,360 | A | 11/1999 | Ophardt | |
| 5,988,412 | A | 11/1999 | Minnette et al. | |
| 6,000,568 | A * | 12/1999 | Verter | B65D 41/3404 215/252 |
| 6,168,035 | B1 * | 1/2001 | McLelland | B65D 50/046 215/216 |
| 7,331,479 | B2 | 2/2008 | Oh | |
| 7,900,789 | B2 | 3/2011 | Johnston et al. | |
| 8,113,388 | B2 | 2/2012 | Ophardt et al. | |
| 8,453,866 | B2 * | 6/2013 | Kamath | B65D 1/0246 220/288 |
| 10,611,511 | B1 * | 4/2020 | Kuzma | B65D 47/08 |
| 2007/0034595 | A1 * | 2/2007 | Foster | B65D 50/043 215/330 |
| 2008/0110850 | A1 * | 5/2008 | Tilton | B65D 41/0471 215/330 |
| 2015/0190827 | A1 | 7/2015 | Ophardt et al. | |
| 2017/0337458 | A1 | 11/2017 | Ophardt et al. | |

* cited by examiner

NON-REMOVABLE CONTAINER ENCLOSURE

RELATED APPLICATION

This application claims the benefit of U.S. provisional patent application Ser. No. 62/637,787 filed Mar. 2, 2018 and claims the benefit of 35 U.S.C. 120.

SCOPE OF THE INVENTION

This invention relates to non-removable threaded couplings and, more particularly, to a collar to be threadably engaged in a threaded neck of a container against removal by a ratchet arrangement.

BACKGROUND OF THE INVENTION

Many closure systems are known in which on threading a closure onto the threaded neck of a container, mutually engaging ratchet teeth on the closure and the neck serve to positively lock the closure in place against removal. One example of such a ratcheting enclosure is disclosed in U.S. Pat. No. 5,360,127 to Barriac et al, issued Nov. 1, 1994. Such devices suffer the disadvantage that the provision of the ratcheting teeth on the closure and the neck require structures in addition to the threads on the closure and the neck.

Hand cleaning dispensers are well known in which a replaceable cartridge comprising a bottle and pump is secured to a threaded neck of the bottle by a threaded collar. In many known prior art systems, the cartridge is engaged to a housing of a dispenser by the collar being secured within a collar retaining mechanism of dimensions precisely corresponding to the axial and radial dimensions of the collar such as in each of U.S. Pat. No. 8,113,388 to Ophardt et al, issued Feb. 14, 2012 and U.S. Patent Publication U.S. 2015/0190827 to Ophardt et al, published Jul. 9, 2015. Previously known prior art devices do not provide for arrangements to render the collar non-removable within the existing structure of known collars and necks.

SUMMARY OF THE INVENTION

To at least partially overcome some of these disadvantages of previously known devices, the present invention provides an improved threaded coupling arrangement for non-removably securing an outer collar member onto an inner tubular member against removal.

In one aspect, the present invention provides a threaded coupling comprising:

an inner tubular member having an radially outwardly directed outer surface and an elongate outboard thread member, the elongate outboard thread member carried on the inner tubular member to extend radially outwardly from the outer surface, the outboard thread member extending circumferentially about the inner tubular member longitudinally from a first end to a second end along a first helix coaxial about the inner tubular member, an outer tubular member having an radially inwardly directed inner surface and an elongate inboard thread member, the elongate inboard thread member carried on the outer tubular member to extend radially inwardly from the inner surface, the inboard thread member comprising a plurality of inboard thread segments disposed end-to-end spaced from adjacent of the segments, the inboard thread member extending circumferentially about the inner tubular member greater than 360 degrees along a second helix coaxial about the outer tubular member complementary to the first helix, wherein with the inner tubular member coaxially located within the outer tubular member with the outer surface in opposition to the inner surface with the inboard thread member and the outboard thread member engaged, on relative coaxial rotation of the outer tubular member relative the inner tubular member in a coupling rotational direction engagement between inboard thread member and the outboard thread member move the outer tubular member axially relative the inner tubular member in a coupling axial direction, the outboard thread member having an axially directed first surface and axially directed second surface directed axially away from the axially directed first surface and merging with the first surface via a radially outwardly directed distal surface, the outboard thread member having a plurality of ratchet slots circumferentially spaced from adjacent ratchet slots along the elongate outboard thread, each ratchet slot extending radially inwardly from the distal surface of the outboard thread member axially between the first surface and the second surface and circumferentially between a first circumferential end of the ratchet slot and a second circumferential end of the ratchet slot, a tangentially directed ratchet stop surface provided at the first circumferential end of each ratchet slot, the inboard thread member having a axially directed first surface and axially directed second surface directed axially away from the axially directed first surface and merging with the first surface via a radially inwardly directed distal surface, the inner surface of the outer tubular member providing a plurality of spacing gaps located between adjacent of the inboard thread segments with each spacing gap spacing adjacent of the inboard thread segments, the outer tubular member carrying a plurality of resilient stop fingers, each stop finger coupled to the outer tubular member within a respective one of the spacing gaps at a first end of the stop finger, each stop finger extending from the first end to a distal stop end located within the spacing gap, each stop finger in an unbiased position extending radially inwardly a greater extent than the radially inwardly directed distal surface the inboard thread member, each resilient stop finger deflectable from the unbiased position to biased positions in which the distal stop end is displaced radially outward from the unbiased position with an inherent bias of the stop finger biasing the stop finger radially inwardly from the biased positions toward the unbiased position, wherein with the inboard thread member and the outboard thread member engaged with relative coaxial rotation of the outer tubular member relative the inner tubular member in the coupling rotational direction and engagement between inboard thread member and the outboard thread member, the outwardly directed distal surface of the outboard thread member engages each stop finger to deflect the stop finger from the unbiased position to biased positions until the relative rotation brings the stop finger into one of the ratchet slots and the stop finger deflects from the biased positions toward the unbiased position locating the distal stop end within the ratchet slot in opposition to the ratchet stop surface, wherein with the distal end of one of the stop fingers located within one of the ratchet slots relative coaxial rotation of the outer tubular member and the inner tubular member in an uncoupling rotational direction opposite to the coupling rotational direction is prevented by engagement between the distal stop end of the one stop finger and the ratchet stop surface of the one ratchet slot.

In another aspect, the present invention provides a threaded coupling comprising:

an inner tubular member having a radially outwardly directed outer surface and an elongate outboard thread member, the elongate outboard thread member carried on the inner tubular member to extend radially outwardly from the outer surface, the outboard thread member extending longitudinally from a first end to a second end along a first helix coaxial about the inner tubular member, an outer tubular member having an radially inwardly directed inner surface and an elongate inboard thread member, the elongate inboard thread member carried on the outer tubular member to extend radially inwardly from the inner surface, the inboard thread member extending longitudinally from a first end to a second end along a second helix coaxial about the outer tubular member complementary to the first helix, wherein with the inner tubular member coaxially located within the outer tubular member with the outer surface in opposition to the inner surface with the outboard thread member and the inboard thread member engaged on relative coaxial rotation of the outer tubular member relative the inner tubular member in a coupling rotational direction engagement between the outboard thread member and the inboard thread member moves the outer tubular member axially relative the inner tubular member in a coupling axial direction, the outboard thread member having an axially directed first surface and axially directed second surface directed axially away from the axially directed first surface and merging with the first surface via a radially outwardly directed distal surface, the outboard thread member having a ratchet slot extending radially inwardly from the distal surface axially between the first surface and the second surface and circumferentially between a first circumferential end of the ratchet slot and a second circumferential end of the ratchet slot, a tangentially directed ratchet stop surface provided at the first circumferential end of the ratchet slot, the inboard thread member having an axially directed first surface and axially directed second surface directed axially away from the axially directed first surface and merging with the first surface via a radially inwardly directed distal surface, the inboard thread member having a spacing gap extending radially inwardly from the distal surface to the outer surface axially between the first surface of the inboard thread member and the second surface of the inboard thread member, the gap circumferentially spacing a first end portion of the inboard thread member from a second end portion of the inboard thread member, the outer tubular member carrying a resilient stop finger coupled to the outer tubular member within the gap at a first end of the stop finger and extending from the first end to a distal stop end located within the gap, the stop finger in an unbiased position extending radially inwardly beyond the radially inwardly directed distal surface the inboard thread member, the stop finger deflectable from the unbiased position to biased positions in which the distal stop end is displaced radially outward from the unbiased position with an inherent bias of the stop finger biasing the finger radially inwardly from the biased positions toward the unbiased position, wherein with the inboard thread member and the outboard thread member engaged with relative coaxial rotation of the outer tubular member relative the inner tubular member in the coupling rotational direction and engagement between inboard thread member and the outboard thread member, the radially outwardly directed distal surface of the outboard thread member engages the stop finger to deflect the stop finger from the unbiased position to biased positions until the relative coaxial rotation brings the stop finger into the ratchet slot and the stop finger deflects from the biased positions toward the unbiased position locating the distal stop end of the stop finger within the ratchet slot in opposition to the ratchet stop surface, wherein with the distal end the stop finger located within the ratchet slot relative coaxial rotation of the outer tubular member and the inner tubular member in an uncoupling rotational direction opposite to the coupling rotational direction is prevented by engagement between the distal stop end of the stop finger and the ratchet stop surface.

BRIEF DESCRIPTION OF THE DRAWINGS

Further aspects and advantages of the invention will become apparent from the following description taken together with the accompanying drawings in which.

DETAILED DESCRIPTION OF THE DRAWINGS

Figure 1:
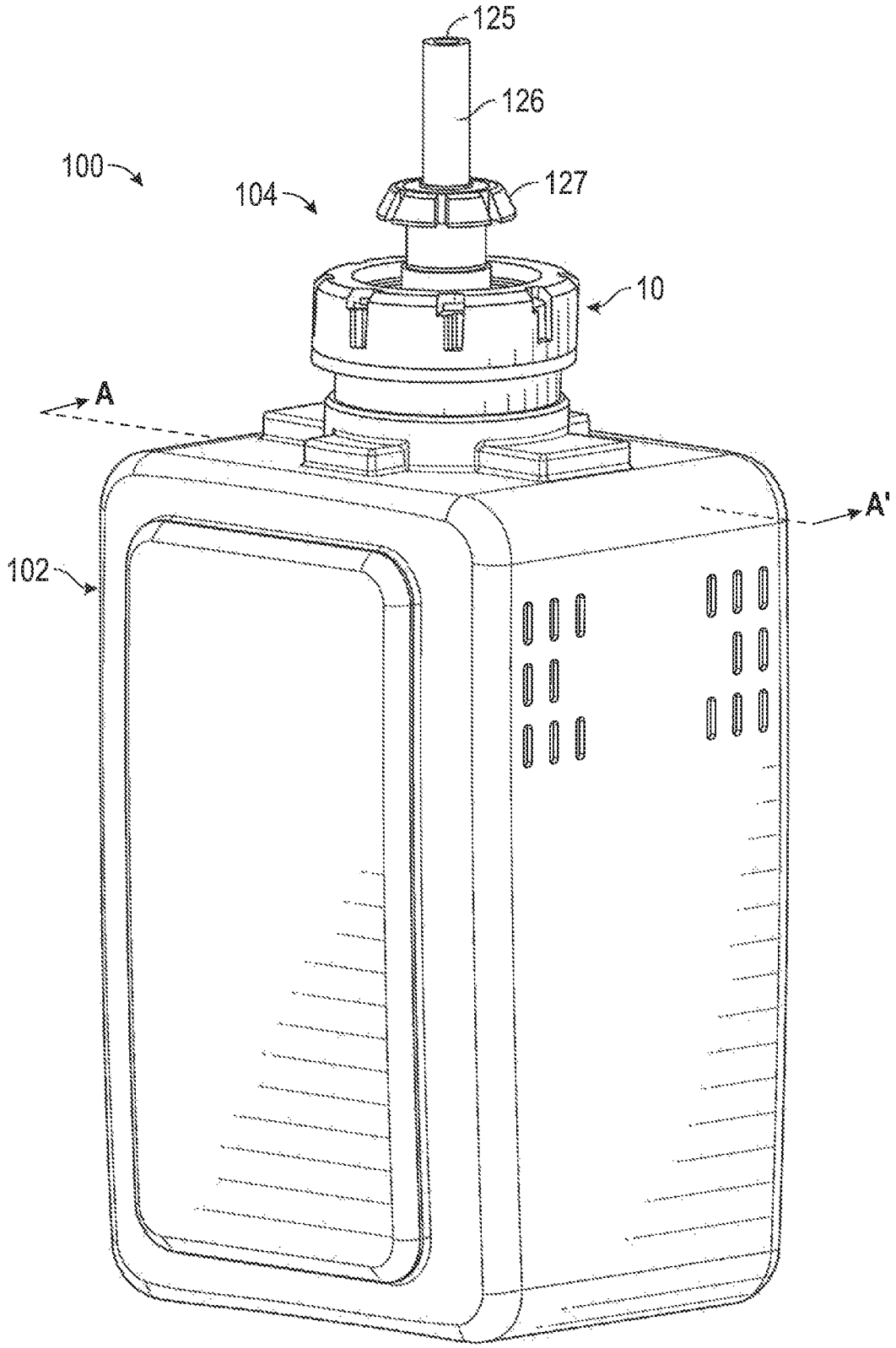
FIG. 1 is a perspective view of a removable cartridge in accordance with a first embodiment of the present invention.
Figure 2:
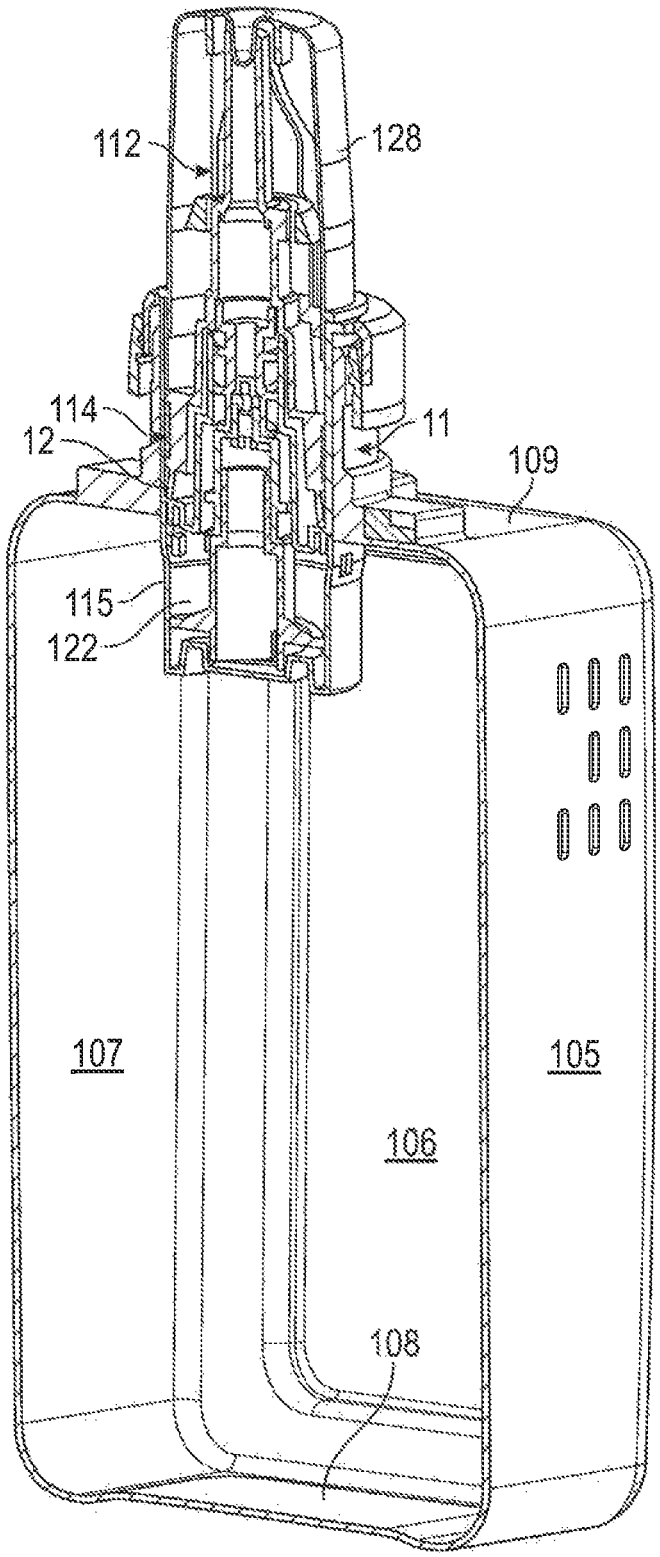
FIG. 2 is a vertical front cross-sectional view of the cartridge of FIG. 1 along section line A-A' in FIG. 1 and also showing a removable closure coupled to the cartridge.
Figure 4:
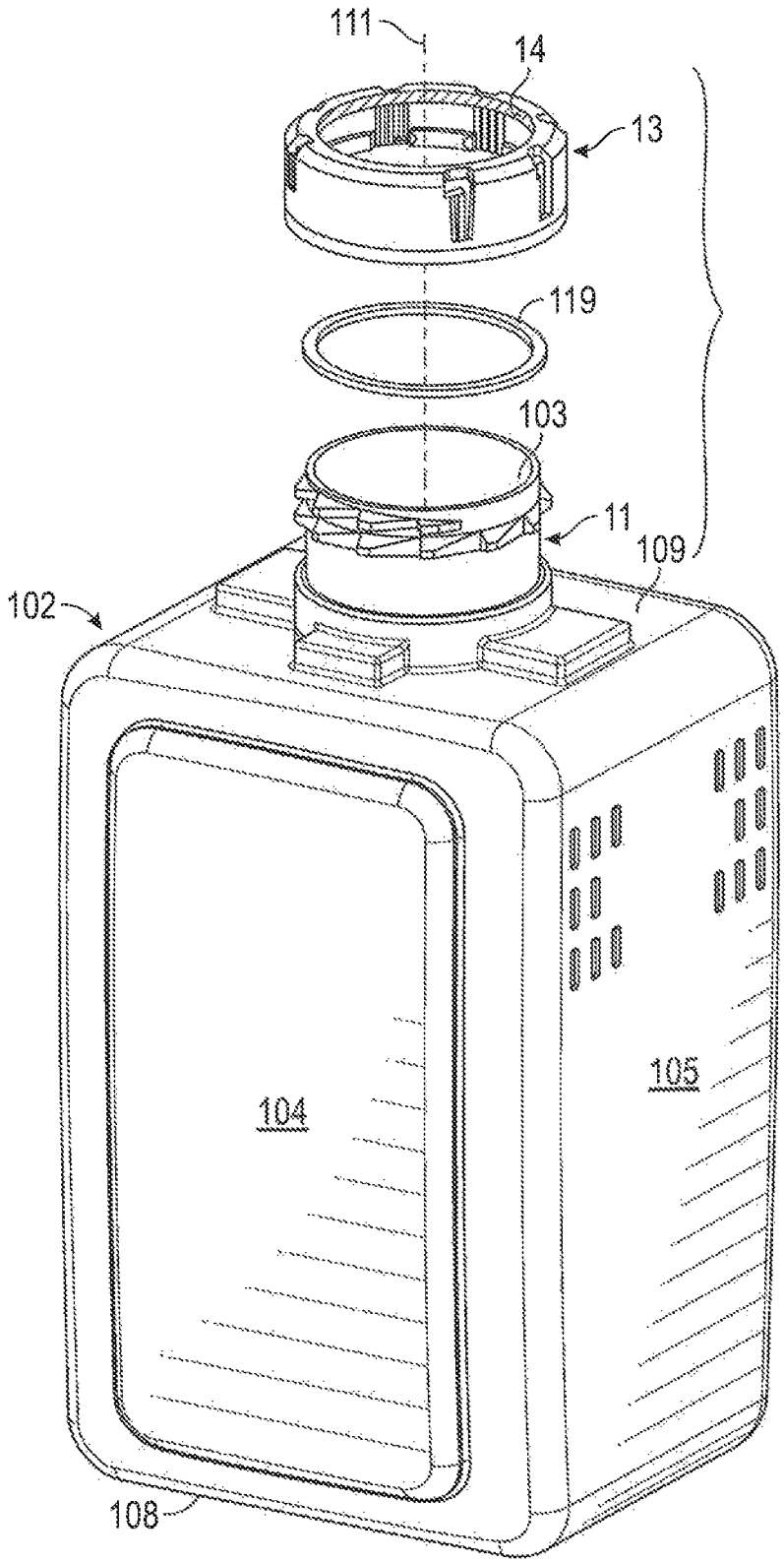
FIG. 4 is an exploded front pictorial view of the container of FIG. 3 in which the cap member is cross-sectioned along an axial extension of the annular dashed line B marked on FIG. 3 so as to show merely an annular radial outer collar member of the cap member.

Reference is made first to FIGS. 1 and 2 illustrating a cartridge 100 comprising a bottle or container 102 to which a pump mechanism 104 is secured against removal using a threaded coupling arrangement 10 in accordance with the present invention. As can be seen in FIG. 4, the container 102 is enclosed but for an opening 103. The container 102, as can be seen in FIGS. 2 and 4, has a front wall 104, a right side wall 105, a rear wall 106, a left side wall 107 as well as a bottom wall 108 and a top wall 109. The top wall 109 merges upwardly as seen in FIG. 4 into a tubular inner member or neck member 11 that opens at an upper, outer end as the opening 103. The container 102 is enclosed but for the opening 103 through the neck member 110. The tubular neck member 11 is coaxial about an axis 111.

As can be seen in FIGS. 1 and 2, the pump mechanism 104 is fixedly secured to the neck member 11. The pump mechanism 104 includes a piston chamber-forming body 112 and a piston-forming element 114. The piston chamber-forming body 112 is formed by a cap member 12 and an inner air bore member 115 which are fixedly coupled together. As best seen on FIG. 3, the cap member 12 includes a collar member 13 having an annular ring end wall 14 from which an interior tubular structure 209 extends inwardly. The interior tubular structure 209 includes a cylindrical interior tube 115 that extends inwardly from the top annular ring wall 14 of the collar member 13 to radially inwardly extending shoulder 116 that merges with an axially outwardly extending innermost stepped diameter tube 117 open at an upper outer end 118. As seen on FIG. 3, dashed lines B represent an annular plane cylindrical about the axis 111 about which the collar member 13 is cross-sectioned at a juncture between the collar member 13 and the interior tubular member 109. For ease of illustration in each of FIGS. 4 and 12 to 16, the cap member 12 is shown as cross-sectioned merely as the collar member 13.

Figure 3:
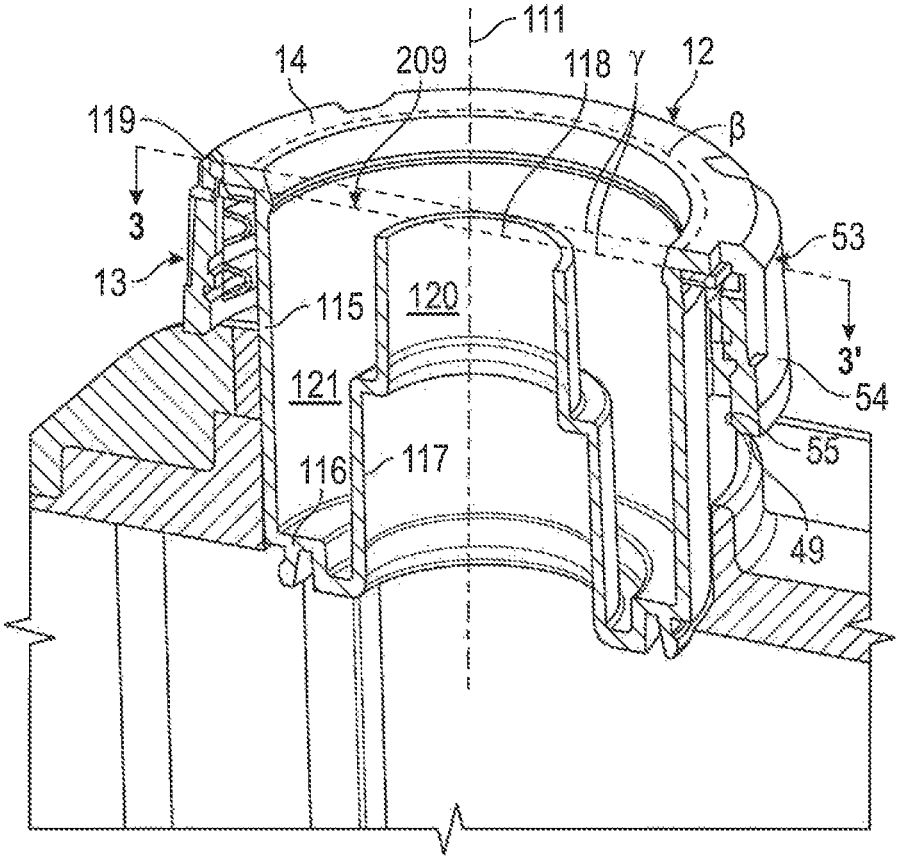
FIG. 3 is an enlarged view showing portions of the cross-section in FIG. 2 limited to a container, a cap member and a gasket member.

As seen in FIG. 3, the collar member 13 is threadably engaged onto the threaded neck member 11 with a resilient gasket 119 compressed disposed therebetween to form a fluid impermeable seal. The piston chamber-forming body 112 forms a stepped liquid chamber 120 within the innermost tube 117, an annular first air chamber 121 between the interior tube 115 and the innermost tube 117 and a second air chamber 122 within the inner air bore member 115. The piston-forming element 114 is disposed to be coaxially slidable within the piston chamber-forming body 112 to form a liquid pump within the stepped liquid chamber 120, a first air pump within the first air chamber 121 and a second air pump within the second air chamber 122. The piston-forming element 114 has a discharge tube 125 extending axially outwardly from the cap member 12 presenting a discharge outlet 127 via which liquid from within the container 102 and air from the atmosphere may be discharged by operation of the liquid pump and first and second air pumps, with the liquid and air mixed together as foam. The discharge tube 126 of the piston-forming element 114 carries an engagement flange 127 axially outwardly of the cap member 12 for engagement to move the piston-forming element 114 relative to the piston chamber-forming body 112 to discharge the liquid and air. With portions of the piston-forming element 114 disposed axially inwardly of the stepped liquid chamber 120 and being of a diameter greater than the diameter of the outer smaller diameter portion of the stepped chamber 120, the piston-forming element 114 cannot be removed from the cap member 12 without disengaging interior portions of the piston-forming element 114 and disabling the liquid pump and air pumps.

As seen in FIG. 2, a cover member 128 is provided secured in snap-fit at an inner end of the cover member 128 with the cap member 12 to seal the piston-forming element 114 within the cap member 12 as for transportation and storage. The cover member 128 is removable for use of the pump mechanism 104.

Reference is made to FIGS. 5 to 11 describing the neck member 11 of the container 102. The neck member 11 is also referred to as an inner tubular member 11. The neck or inner tubular member 11 has a radially outwardly directed outer surface 20 which is cylindrical and disposed about the neck axis 111. The neck member 11 ends at an annular outer end surface 21. An elongate outboard thread member 22 is carried on the inner tubular member 11 to extend radially outwardly from the outer surface 20. The outboard thread member 22 extends circumferentially about the inner tubular member 11 longitudinally from an entrance end 23 to a tail end 24 along a helix coaxial with the axis 111 about the inner tubular member 11. The outboard thread member 22 has an axially directed first surface 25 and an axially directed second surface 27 directed axially away from the axially directed first surface 25. The axially directed first surface 25 and the axially directed second surface 27 extend radially outwardly from the outer surface 20 and each merge together via a radially outwardly directed distal surface 26.

The outboard thread member 22 has a plurality of ratchet slots 28 spaced from adjacent ratchet slots 28 longitudinally along the elongate outboard thread member 22. Each ratchet slot 28 extends radially inwardly from the distal surface 26 axially between the first surface 25 and the second surface 27 and circumferentially between a first circumferential end 30 of the ratchet slot 28 and a second circumferential end 31 of the ratchet slot 28. Each ratchet slot 28 includes a tangentially directed ratchet stop surface 32 at the first circumferential end 30 of each ratchet slot 28 and a camming surface 34 that extends from the second circumferential end 31 to merge with the ratchet stop surface 32 proximate the first circumferential end 30.

Figure 7:
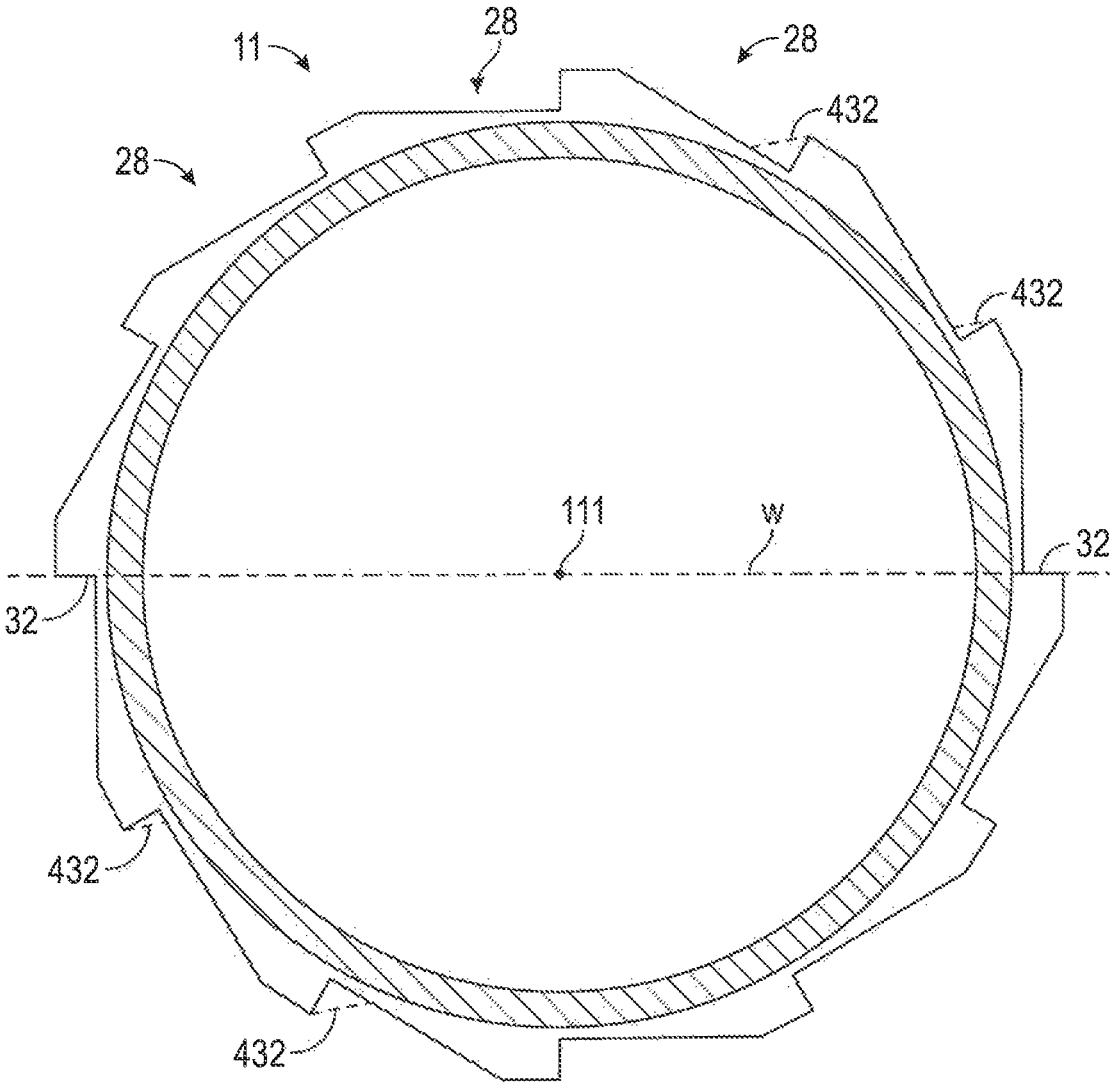
FIG. 7 is a bottom view of FIG. 6.

As is best seen on FIG. 7, each ratchet stop surface 32, as seen in axial view, is disposed in a flat plane to present the ratchet stop surface 32 to be tangentially directed. Eight of the ratchet stop surfaces 32 are disposed in respective flat planes that extends radially through the axis 111 and includes the axis 111. Each ratchet stop surface 32 has a radially outer edge 35 where it merges with the distal surface 26 and a radially inner edge 36 where the ratchet stop surface 32 merges with the camming surface 34. The camming surface 34 of each ratchet slot 28 extends radially outwardly from the edge 36 as the camming surface 34 extends towards the second circumferential end 31 of each ratchet slot 28.

The camming surface 34 extends radially outwardly to merge with the distal surface 26 at the second circumferential end 31 as an edge 37 of the camming surface 34 where the camming surface 34 merges with the distal surface 26.

Figure 5:
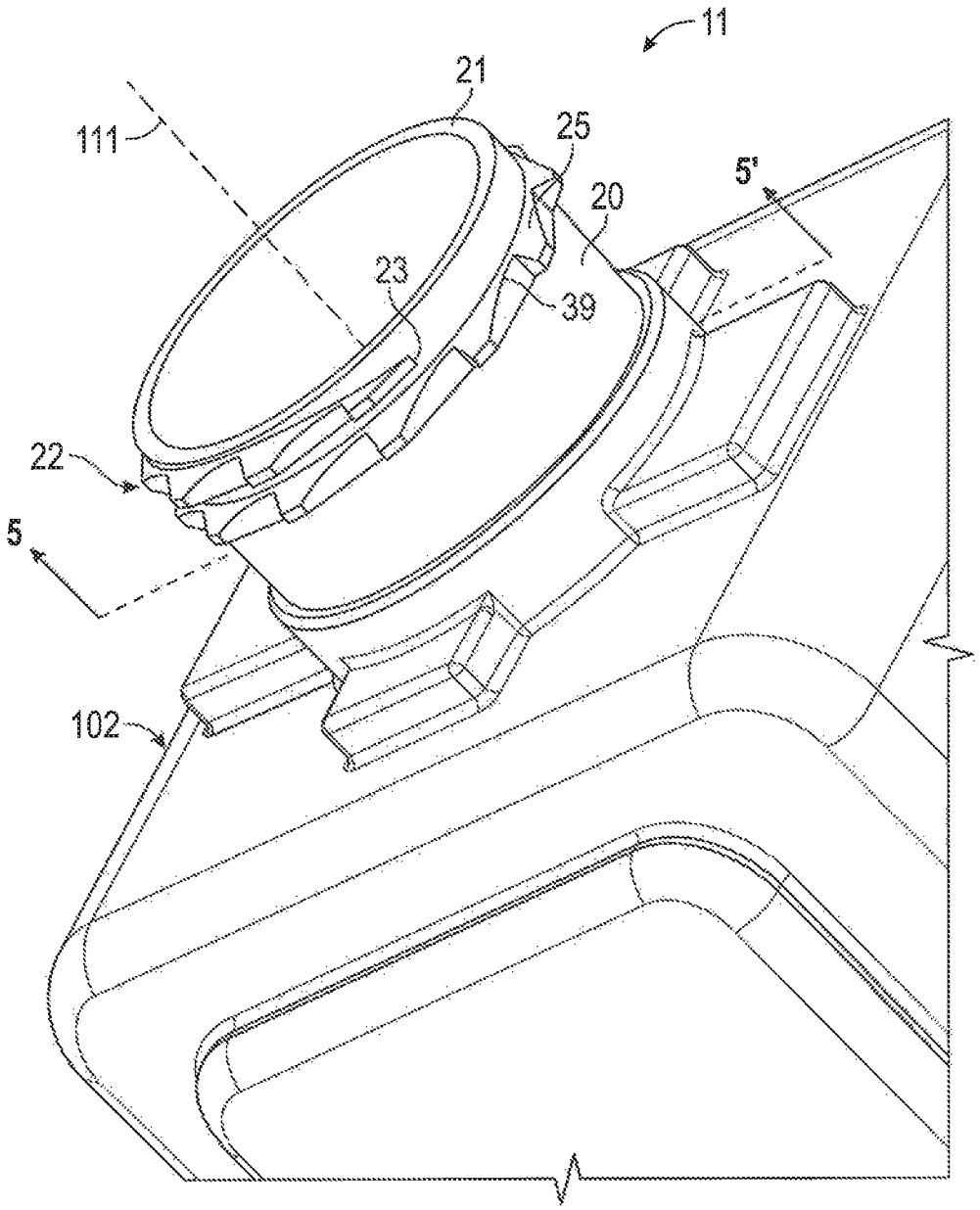
FIG. 5 is an enlarged front pictorial view of the top and neck member of the container shown in FIG. 4.
Figure 6:
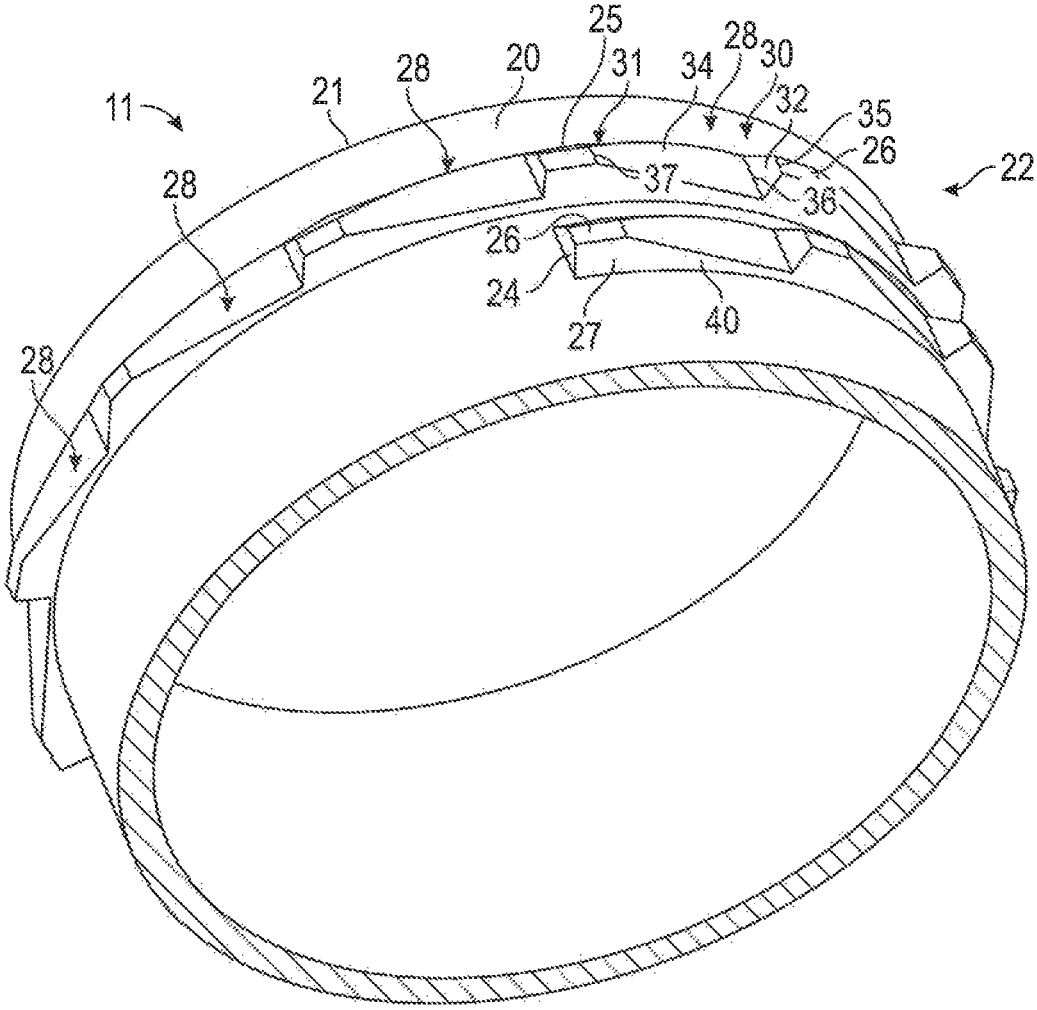
FIG. 6 is a bottom pictorial view showing the neck of the container of FIG. 5 as cross-sectioned along section line 5-5' as seen on FIG. 5 as viewed from the rear of the container.

As can be seen, for example, in FIGS. 5 and 6, each ratchet slot 28 extends radially inwardly from the distal surface 26 to intermediate the distal surface 26 and the outer surface 20 of the inner tubular member 11 so as to provide (a) as seen in FIG. 5, on the outboard thread member 22 along each ratchet slot 28, a longitudinal first shoulder portion 39 of the axially directed first surface 25 between the outer surface 20 in each ratchet slot 28, and (b) as seen in FIG. 6, on the outboard thread member 22 along each ratchet slot 28, a longitudinal second shoulder portion 40 of the axially directed second surface 27 between the outer surface 20 and each ratchet slot 28.

As can be seen in FIG. 7, twelve ratchet slots 28 are provided in the 360 degree circumference of the inner tubular member 11 with each ratchet stop surface 32 being located circumferentially displaced 30 degrees from adjacent ratchet stop surfaces 32. The outboard thread member 22 is disposed in a first helix 41 about the axis 111 schematically shown in dashed lines on some of FIGS. 8 to 11 that increase with distance from the end surface 21 of the inner tubular member 11 as the outboard thread member 22 extends from its entrance end 23 to its tail end 24. The outboard thread member 22 extends circumferentially about the inner tubular member 11 about 590 degrees about the first axis 111 such that from the entrance end 22 after the outboard thread member 22 extends 360 degrees from the entrance end 22, the outboard thread member 22 provides two parallel axially spaced courses, for example, indicated as an outer thread portion 42 and an inner thread portion 43 as seen, for example, on FIG. 11, each along axially spaced adjacent coils 44 and 45 of the first helix 41.

Figure 8:
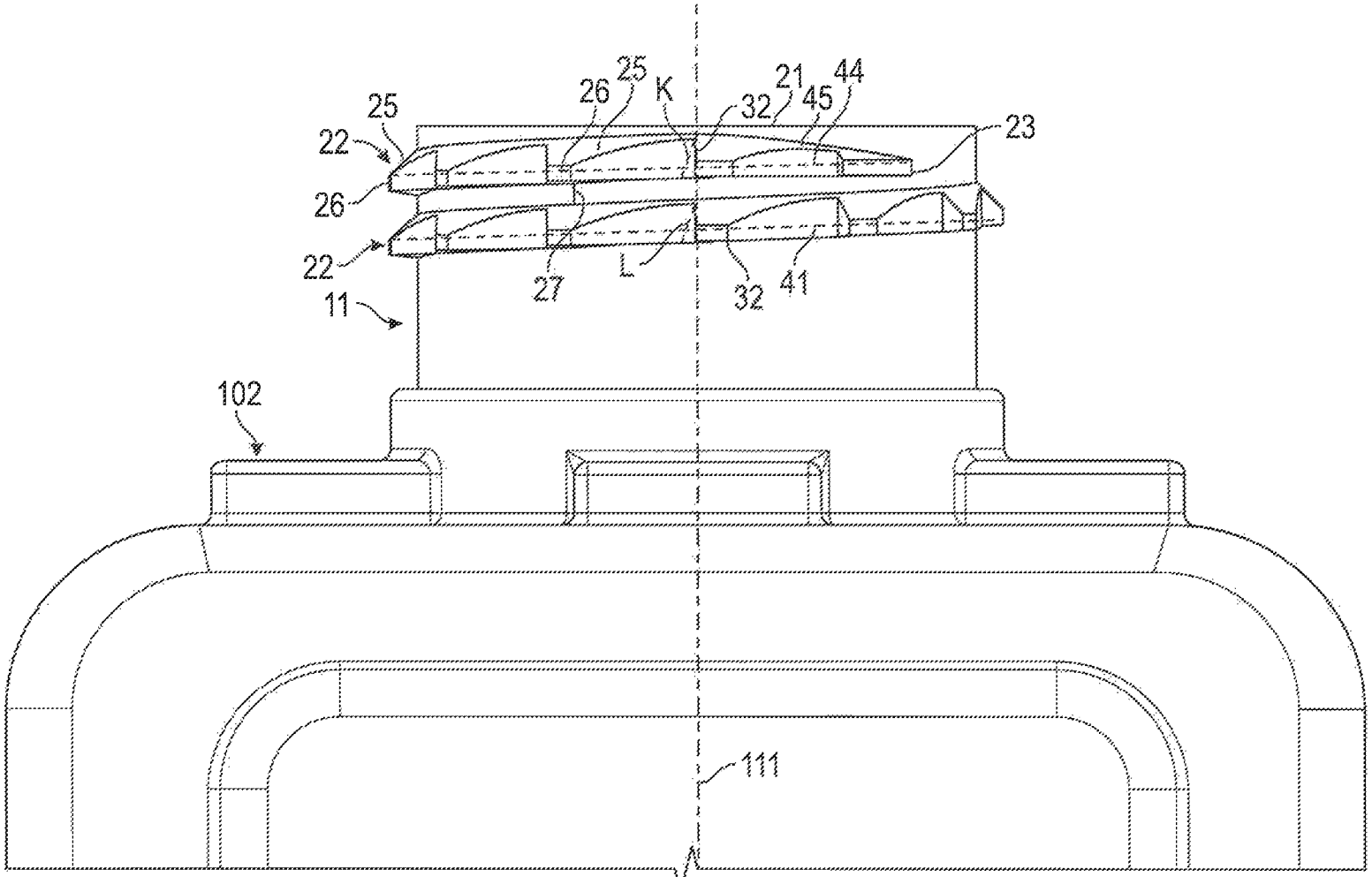
FIG. 8 is a front view of the neck and top of the container of FIG. 5.
Figure 9:
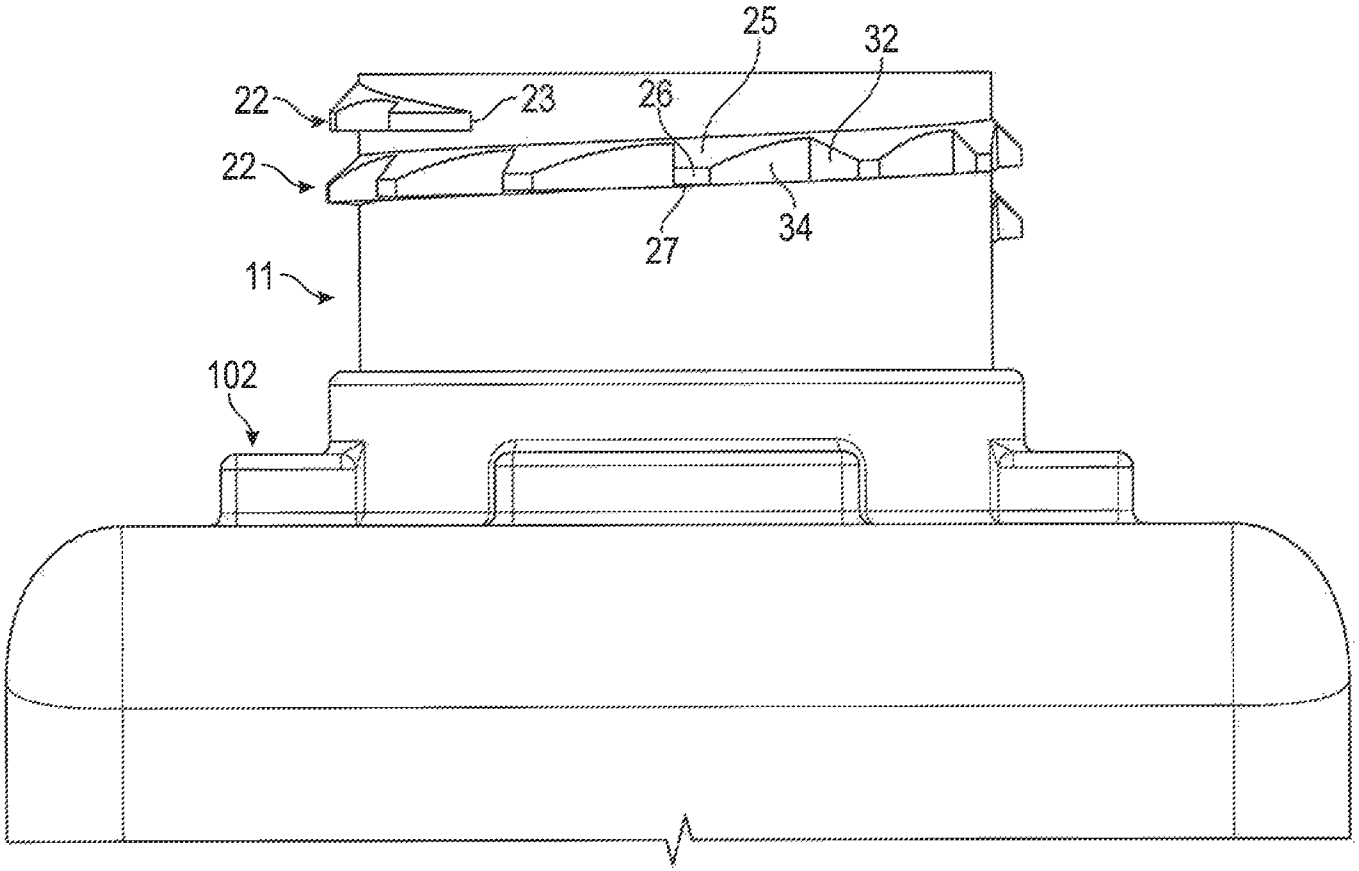
FIG. 9 is a right side view of the neck and top of the container of FIG. 5.
Figure 10:
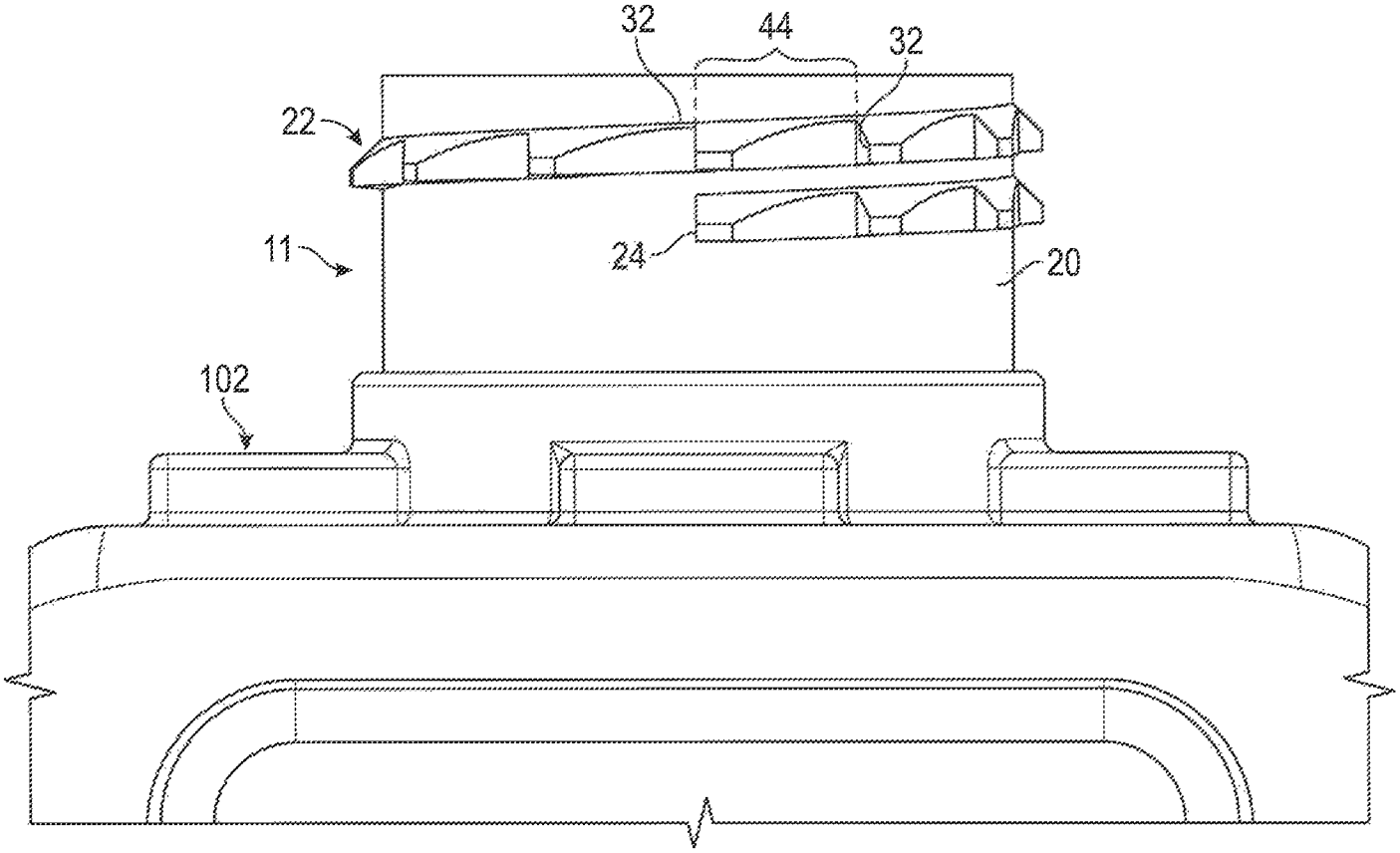
FIG. 10 is a rear view of the neck and top of the container of FIG. 5.
Figure 11:
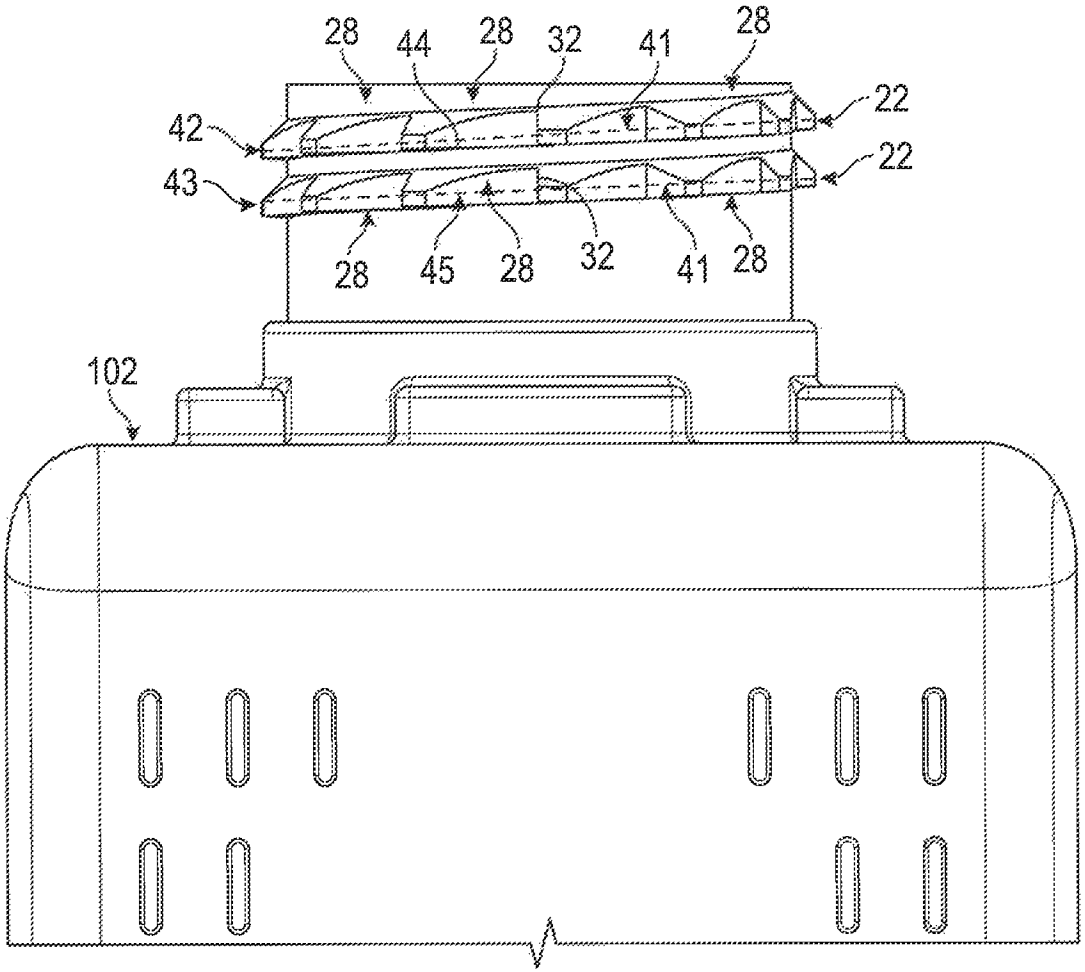
FIG. 11 is a left side view of the neck and top of the container of FIG. 5.

As can be seen on FIG. 11, each of the ratchet slots 28 on the outboard thread member 22 are identical and, as well, the ratchet slots 28 on the inner thread portion 43 and the ratchet slots 28 on the outer thread portion 42 coaxially aligned, that is, with ratchet stop surfaces 32 on the outer thread portion 42 and ratchet stop surfaces 32 on the inner thread portion 43 at the same circumferential positions and with identical ratchet slots 28 aligned axially at axially corresponding locations. As can be seen on FIG. 10, the outboard thread member 22 may be considered to comprise a plurality of longitudinally arranged identical outboard thread segments 44 extending between adjacent ratchet stop surfaces 32. An exception, as seen in FIG. 8, is that what may be considered as an entrance thread segment 45 of the outboard thread member 22 at the entrance end 23 reduces in axial extent and radial extent from an adjacent outboard thread segment 44 toward entrance end 23 to facilitate initial engagement with an inboard thread member on the collar member 13. As is apparent from FIG. 3 and, as well, for example, from FIG. 8, corresponding axially aligned ratchet stop surfaces 32 on the outer thread portion 42 and on the inner thread portion 43 are directed circumferentially disposed in the same plane, preferably a flat plane that extends radially from the axis 111 and includes the axis 111.

As can be seen in side views such as in FIG. 8, the axially directed first surface 25 of the outboard thread member 22 extends axially inwardly as it extends radially outwardly. The axially directed second surface 27 effectively extends merely radially outwardly.

Reference is made to FIGS. 12 to 16 illustrating the collar member 13. The collar member 13 has the ring end wall 14 defined between an axially outwardly directed outer surface 46 and an axially inwardly directed inner surface 47. The ring end wall 14 extends radially outwardly to where it merges with an outer tubular member 53 that extends axially inwardly to an annular inner end surface 49. The outer tubular member 53 has a radially outwardly directed outer surface 54 and a radially inwardly directed inner surface 55, each being coaxial about a cap axis 211 and cylindrical. An inboard thread member 56 is carried on the outer tubular member 53 to extend radially inwardly from the inner surface 55. The inboard thread member 56 comprises a plurality of inboard thread segments 57 disposed end-to-end spaced from adjacent of the inboard thread segments 57. The inboard thread member 56 extends circumferentially about the outer tubular member 53 along a second helix 51 coaxial about the axis 211 schematically shown in dashed lines in FIG. 15 of the outer tubular member 53. The inboard thread member 56 and each of the inboard thread segments 57 has an axially directed first surface 58 and axially directed second surface 59 directed axially away from the axially directed first surface 58. The axially directed first surface 58 and the axially directed second surface 59 merge remote from the inner surface 55 via a radially inwardly directed distal surface 60. Each of the inboard segments 57 extends along the second helix 51 from a first end 61 to a second end 62. At the first end 61, a first end surface 63 is provided which extends circumferentially towards a second end 62 as it extends radially inwardly. At the second end 62, a second end surface 64 is provided which extends circumferentially towards the first end 61 as it extends radially inwardly. Between adjacent of the inboard thread segments 57, that is, between a first end 61 of the inboard thread segment 59 and a second end 62 of an adjacent thread segment 57, the inner surface 55 of the outer tubular member 53 is provided with a spacing gap 66 such that a plurality of circumferentially spaced spacing gaps 66 are provided with each spacing gap 66 circumferentially spacing an opposed first end 61 and a second end 62 of adjacent inboard thread segments 57.

Figure 14:
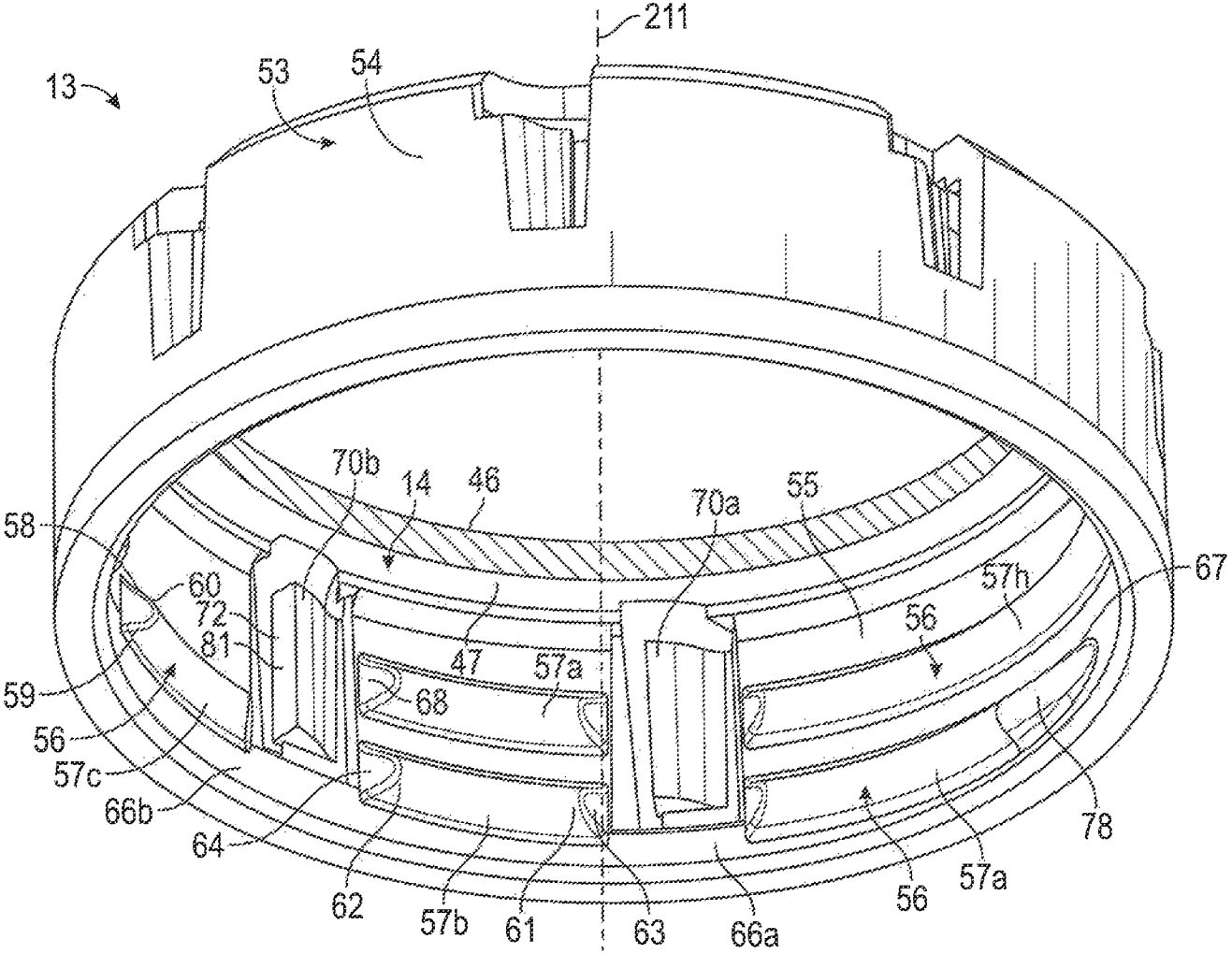
FIG. 14 is a first bottom perspective view of the collar member of FIG. 4 as seen looking upwardly in the direction of arrow D on FIG. 13.
Figure 15:
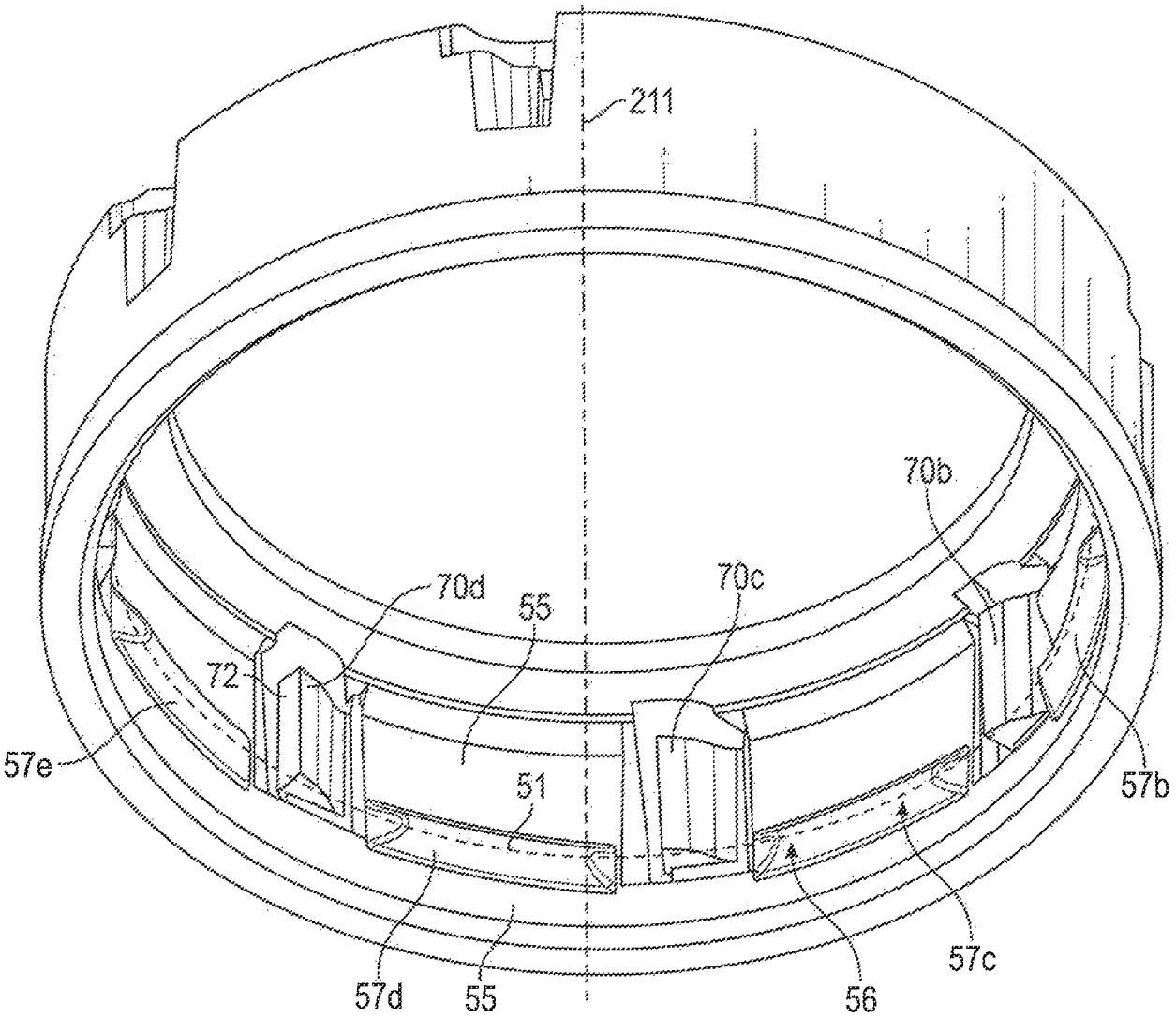
FIG. 15 is a second bottom perspective view of the collar member of FIG. 4 as seen looking upwardly in the direction of arrow E on FIG. 13.
Figure 16:
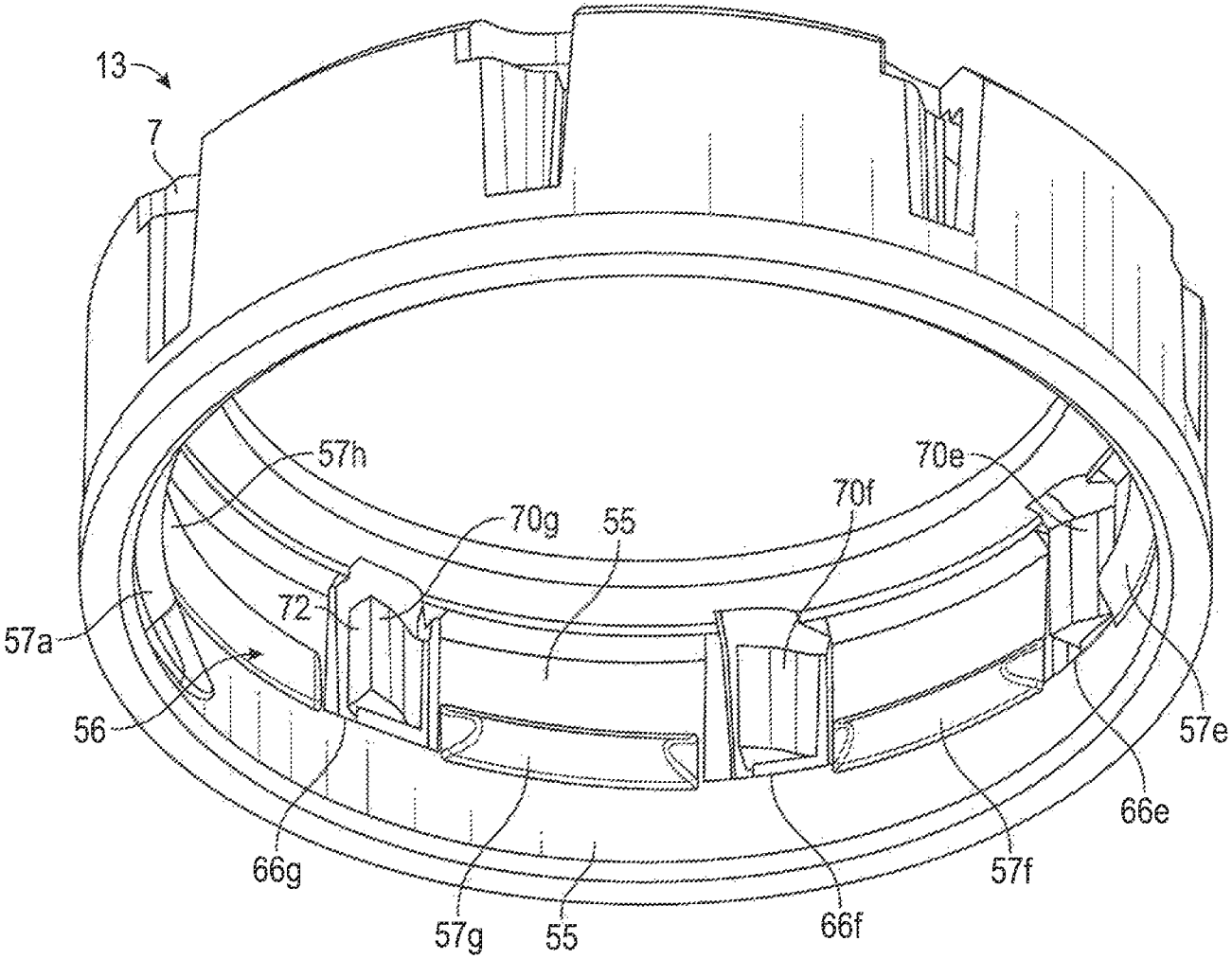
FIG. 16 is a third bottom perspective view of the collar member of FIG. 4 as seen looking upwardly in the direction of arrow F on FIG. 13.

On FIGS. 14 to 16, seven different spacing gaps 66 are provided and, for ease of discussion, these are designated as gaps 66*a* to 66*g*.

As can be seen in FIG. 14, the inboard thread member 56 extends from an entrance end 67 to a tail end 68 as a clockwise helix extending about 450 degrees about the second axis 211 in a sequence of inboard thread segments 57 identified on FIGS. 13 to 16 as inboard thread segments 57*a* to 57*i*. From the entrance end 67 after the inboard thread member 56 extends beyond 360 degrees from the entrance end 67, the inboard thread member 56 provides two parallel axially spaced courses with certain of the inboard thread segments 57 axially inward other of the inboard thread segments 57, each along axially spaced adjacent coils of the second helix 51. The inboard thread segments 57*b* and 57*i* are identical and have their respective first ends 61 and second ends 62 axially aligned at the same circumferential position. As seen, for example, in FIG. 14, inboard thread segment 57*b* is axially inward from inboard thread segment 57*i* and inboard thread segment 57*a* is axially inward of inboard thread segment 57*h*, each at the same circumferential axially aligned position. The spacing gaps 66 between the ends of the axially spaced corresponding inboard thread segments 57 in the different courses are axially aligned and extend axially through adjacent courses, for example, the gap 66*a* between the ends of the inboard thread segments 57*h* and 57*i* also extends axially between the ends of the inboard thread segments 57*a* and 57*b*. Thus, the spacing gaps 66 between inboard thread segments 57 in axially spaced courses are provided as corresponding identical spacing gaps 66 axially aligned at axially corresponding locations.

Within each of the spacing gaps 66, a resilient stop finger 70 is provided. Each stop finger 70 is coupled to the outer tubular member 53 within a respective one of the spacing gaps 66 at a first end 71 of the stop finger. Each stop finger 70 extends from the first end 71 to a distal stop end 72 located within the respective spacing gap 66.

Figure 12:
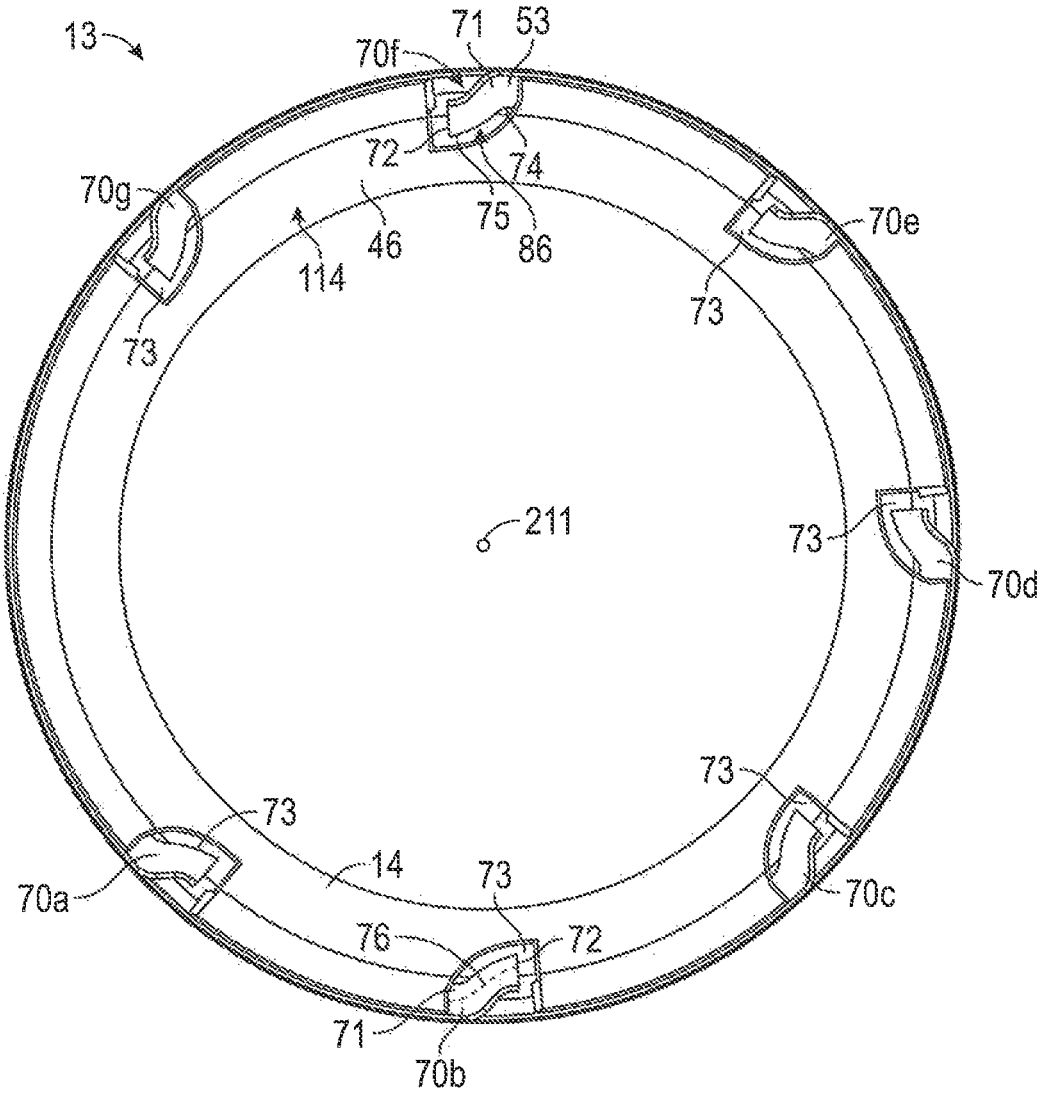
FIG. 12 is a top view of the collar member of FIG. 4.
Figure 13:
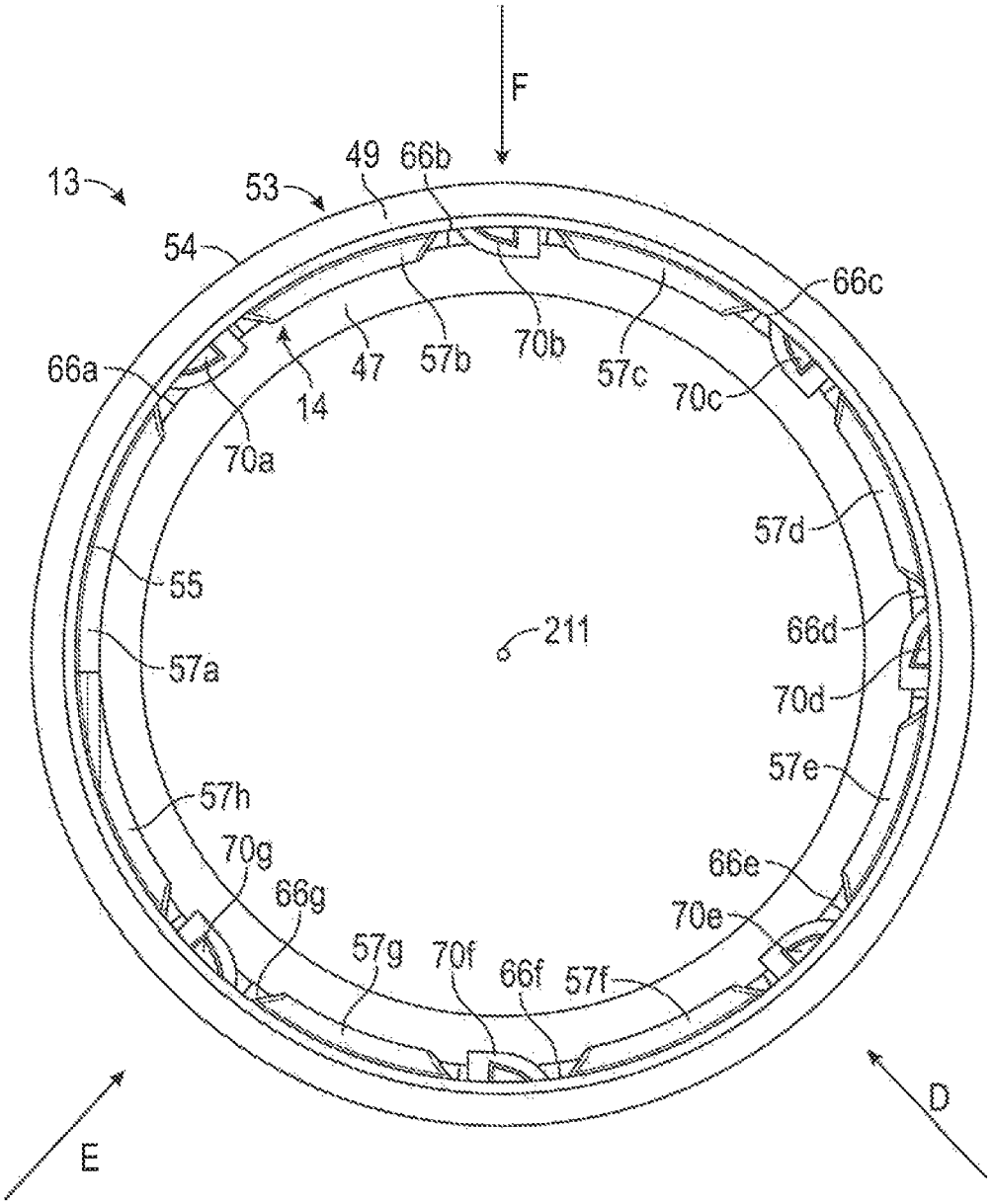
FIG. 13 is a bottom view of the collar member of FIG. 4.

Referring to FIG. 12, the annular ring end wall 14 is shown as being cut away axially in line with each spacing gap 66 providing a plurality of axially extending access openings 73. As can be seen through these axial access openings 73, each stop finger 70 merges with the outer tubular member 53 at the first end 71 of the stop finger 70. Each stop finger 70 then extends radially inwardly as it extends circumferentially away from the first end 71 over an outer curved portion 74 then circumferentially inwardly as it extends radially outwardly over an inner curved portion 75 so as to present the distal stop end 72 disposed in a flat plane that extends radially from the second axis 211 parallel the axis 211 and includes the axis 211. Each stop finger 70 is formed from a resilient material preferably by reason of the cap member 12 including the collar member 13 being formed as integral member by injection molding from a plastic material that provides a suitable resiliency for the stop finger 70. Each stop finger 70 is resilient and preferably in an unbiased position as shown in FIG. 12 extends radially inwardly from the radially inwardly directed inner surface 55 a greater extent than the radially inwardly directed distal surface 60 of the inboard thread member 56. Each stop finger 70 is deflectable from the unbiased position as shown in FIGS. 12 to 16 to biased positions in which the distal stop end 72 is displaced radially outwardly from the unbiased position and with an inherent bias of each stop finger 70 biasing the stop finger 70 radially inwardly from the biased positions towards the unbiased position.

As can be seen on FIG. 12, seven stop fingers 70 are provided, designated 70*a* to 70*g*, with there being one stop finger 70 for each of the spacing gaps 66*a* to 66*g*. As seen on FIG. 12, adjacent stop members 70*a* and 70*g* having their distal stop ends spaced 60 degrees and all of the other stop members 70 having their distal ends spaced 30 degrees from the distal ends of adjacent stop members. As can be seen in FIG. 12, each stop finger 70 is provided to extend along a stop finger longitudinal 16 indicated as a dotted line on stop finger 70*b* only from the first end 71 to the distal stop end 72. As best seen on FIG. 14, the stop finger 70*b* and each of the stop fingers 70 has an axial extent transverse to its respective longitudinal.

As is best seen on FIG. 14 as, for example, with the stop finger 70*b* and the stop finger 70*a*, each has an axial extent transverse to the longitudinal of each stop finger sufficient that the stop finger extends axially between adjacent thread segments 57*h* and 57*i* of an outer course of the inboard thread member 56 and also between adjacent thread segments 57*a* and 57*b* of an inner course of the inboard thread member 56.

The inboard thread segments 57*b* to 57*g* and 57*i* are identical. The inboard thread segment 57*a* is to be considered an entrance thread segment and has a distal end portion 78 which reduces towards the entrance end 67 in axial extent and in the radial extent that it extends from the inner surface 55 to assist on initial coupling of the inboard thread member 56 on the outer tubular member 53 with the outboard thread member 22 on the inner tubular member 11.

Each stop member 70 carries a cam surface 86 that is directed radially inwardly and circumferentially away from the distal stop end 72. The distal stop end 72 of each stop finger 70 carries a circumferentially directed engagement surface 81 directed tangentially and circumferentially. Each stop finger 70 has an axial extent transverse to the longitudinal of each stop finger 70 sufficient that the stop finger 70 and the circumferentially directed engagement surface 81 on its distal stop end 72 extends axially through each spacing gap 66 of axially adjacent inboard thread segments 57 of different courses of the inboard thread member 56 as, for example, seen in FIG. 14.

The cap member 12 and notably the collar member 13 of the cap member 12 have been configured so as to permit ease of manufacture by injection molding with a mold component to be disposed axially outwardly of the ring end wall 14 of the collar member 13 with portions of the mold to extend axially to form the access openings 73 through the ring end wall 14 and the axially extending stop finger 70 which mold component can readily be removed by mere axial movement. Other mold components can be provided extending between the collar member 13 and the interior tube 115 to provide, for example, the axial innermost ends of the stop fingers 70.

The outboard thread member 22 carried on the inner tubular member 11 of the container 102 is disposed about the first helix 41 coaxial about the container axis 111 and the inboard thread member 56 on the outer tubular member 53 of the collar member 13 is disposed in a second helix 51 about the second axis 211 complementary to the first helix 41 of the inner tubular member 11. In assembly, the collar member 13 is disposed, as shown on FIG. 4, with the axis 111 and the axis 211 coaxial, that is, with the inner tubular member 11 coaxially located within the outer tubular member 53 with the outer surface 20 of the inner tubular member 11 in opposition to the inner surface 55 of the outer tubular member 53 whereby the inboard thread member 56 and the outboard thread member 22 engage with relative coaxial rotation of the outer tubular member 53 relative the inner tubular member 11. Coupling rotation is in a coupling rotation direction clockwise as viewed from above in FIG. 4. With such coupling rotation engagement between the inboard thread member 56 and the outboard thread member 22 move the outer tubular member 53 axially relative the inner tubular member 11 in an axial coupling direction, that is, in a downward and inward direction as seen in FIG. 4, drawing the collar member 13 onto the tubular member 110 inwardly and towards the top wall 109 of the container 102. In such engagement between the inboard thread member 56 and the outboard thread member 22, the axially inwardly directed second surface 27 of the outboard thread member 22 engages with the axially outwardly directed first surface 58 of the inboard thread member 56. With such threaded engagement, the radially inwardly directed distal surface 26 of the outboard thread member 22 engages with the stop fingers 70 to deflect each stop finger 70 from the unbiased position to biased positions until the relative coupling rotation brings a stop finger 70 into one of the ratchet slots 28. When a stop finger 70 is within one of the ratchet slots 28, the stop finger 70 deflects from the biased positions towards the unbiased position locating the distal stop end 72 within the ratchet slot 28 with the distal stop end 72 in opposition to the ratchet stop surface 32. In coupling rotation in the coupling rotational direction, when a stop finger 70 is within a ratchet slot 28, the camming surface 34 of the ratchet slot 28 will engage the cam surface 86 of the stop finger 70 with rotation in the counter-clockwise coupling rotational direction to deflect the stop finger 70 towards biased positions. Coupling rotation in the clockwise coupling rotational direction continues until the collar member 13 is moved axially inwardly onto the outer tubular member 11 that the gasket 119 is compressed between the stop end surface 21 of the inner tubular member 11 and the axially inwardly directed stop inner surface 47 of the ring end wall 14 of the collar member 13. Whenever the distal stop end 72 of one of the stop fingers 70 is located within one of the ratchet slots 28 relative coaxial rotation of the outer tubular member 53 and the inner tubular member 11 in an uncoupling rotational direction, that is, counter-clockwise, being opposite to the clockwise coupling rotational direction, is or will be prevented by engagement between the distal stop end 72 of the one stop finger 70 and the ratchet stop surface 32 of the one ratchet slot 28.

Figure 17:
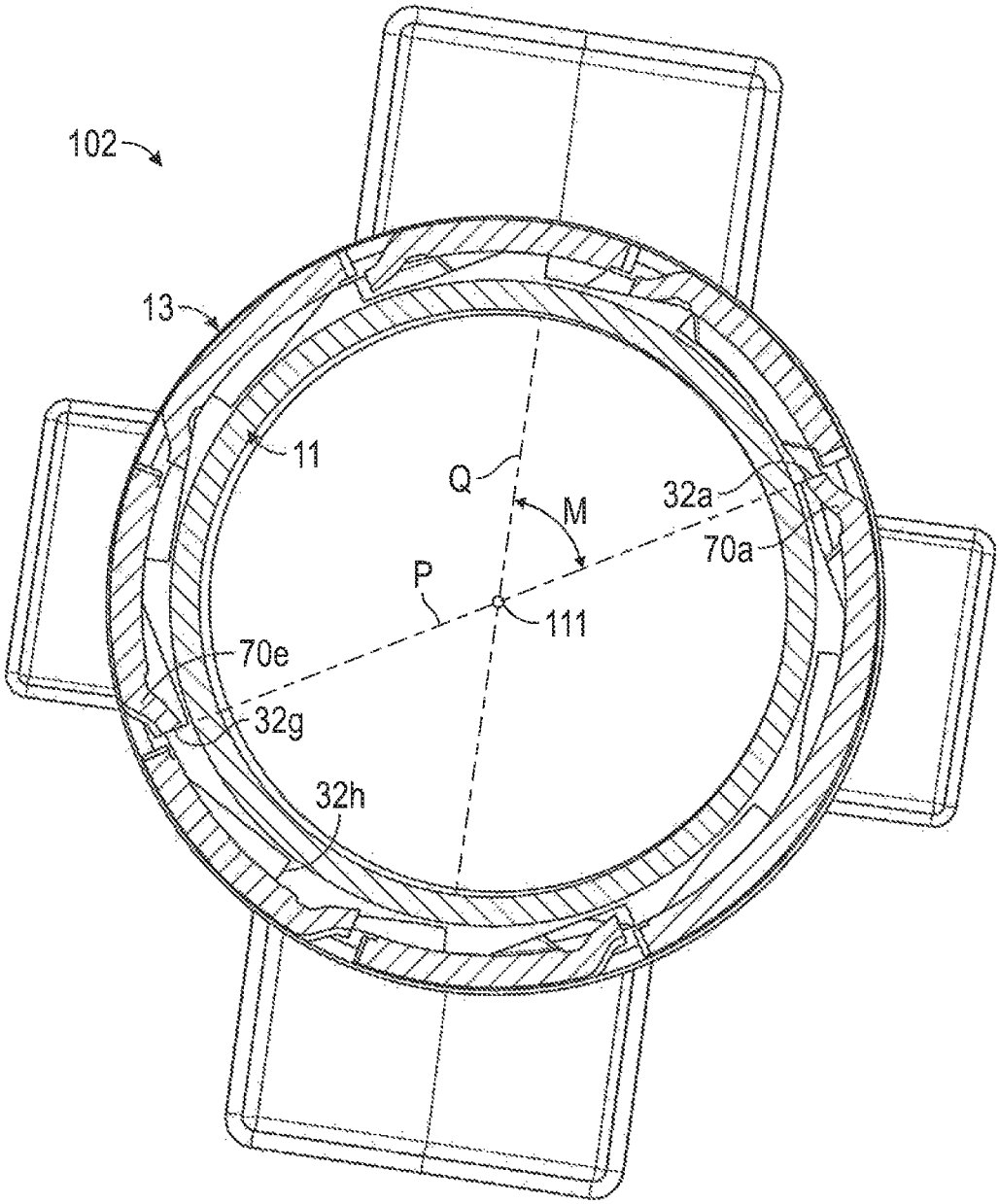
FIG. 17 is a cross-sectional top view along a section line 3-3' shown on FIG. 3 showing merely the collar member of FIG. 4 secured onto the neck member of the container of FIG. 4 in a first rotational position.
Figure 18:
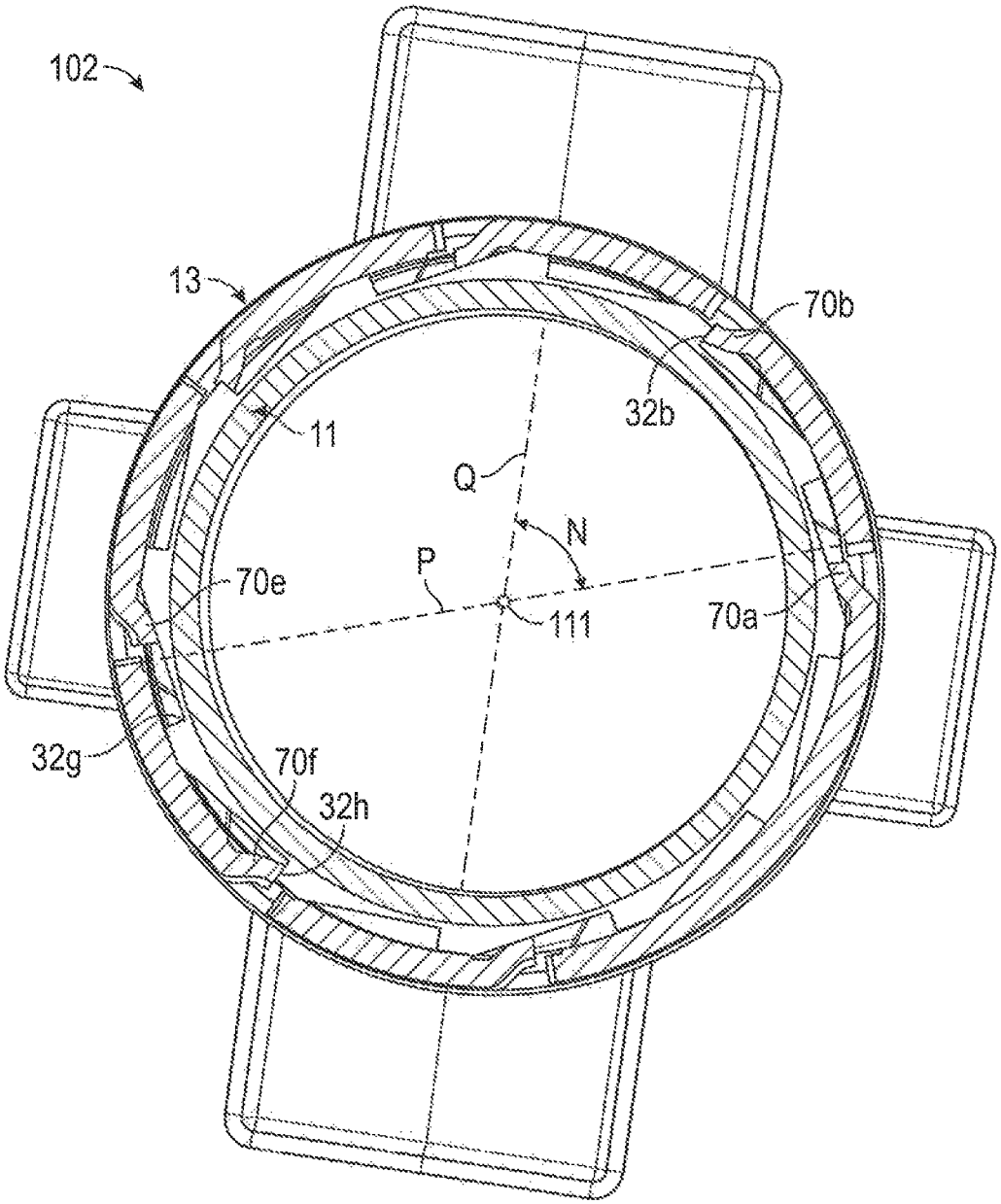
FIG. 18 is a cross-sectional top view identical to FIG. 17 but with the collar member rotated 15 degrees clockwise relative to the neck member of the container.

Reference is made to FIGS. 17 and 18 showing a top cross-sectional view along section line 3-3' in FIG. 3 but showing merely a collar member 13 as in threaded engagement on the inner tubular member 11.

FIG. 17 shows the distal stop ends 72 of the stop finger 70*a*, and 70*e* engaged with ratchet stop surfaces 32*a* and 32*g* of the ratchet stops 28 to prevent relative rotation of the inner tubular member 11 and the outer tubular member 53 in the uncoupling rotational direction. In FIG. 17 the stop finger 70*a*, and 70*e* are located in an axially and radially extending plane P through the axis 111 at an angle M to a front to back radially extending center line Q of the container 102 with the plane P forming an angle M with the center line Q.

FIG. 18 is a top view identical to FIG. 17 but showing the collar member 13 as rotated 15 degrees clockwise from the position of FIG. 17 and illustrating stop fingers 70*b* and 70*f* engaged with ratchet stop surfaces 23*b* and 32*h*. Insofar as the collar member 13 when rotated in the coupling rotational direction is stopped rotating at a position in which no stop finger 70 is within any of the ratchet slots 28, subsequent relative rotation in the uncoupling rotational direction will result in one of the stop fingers 70 becoming located within one of the ratchet slots 28 and, subsequently, the distal stop end 72 of the stop finger 70 will come to engage with the ratchet stop surface 72 of that one ratchet stop 70 to prevent further relative rotation of the inner tubular member 11 and the outer tubular member 53 in the uncoupling direction. In FIG. 18 the stop finger 70*a*, and 70*e* are located in the plane P at an angle N to the center line Q with the angle N being greater than the angle M on FIG. 17 by 15 degrees.

In the embodiment illustrated in FIGS. 17 and 18, should relative rotation in the coupling rotation direction be stopped in any position, then no more than 15 degrees rotation in the uncoupling rotational direction is required before the distal stop end 72 of one stop finger 70 will become engaged with a ratchet stop surface 32 of one of the ratchet slots 28 to prevent further relative rotation in the uncoupling rotational direction.

Figure 19:
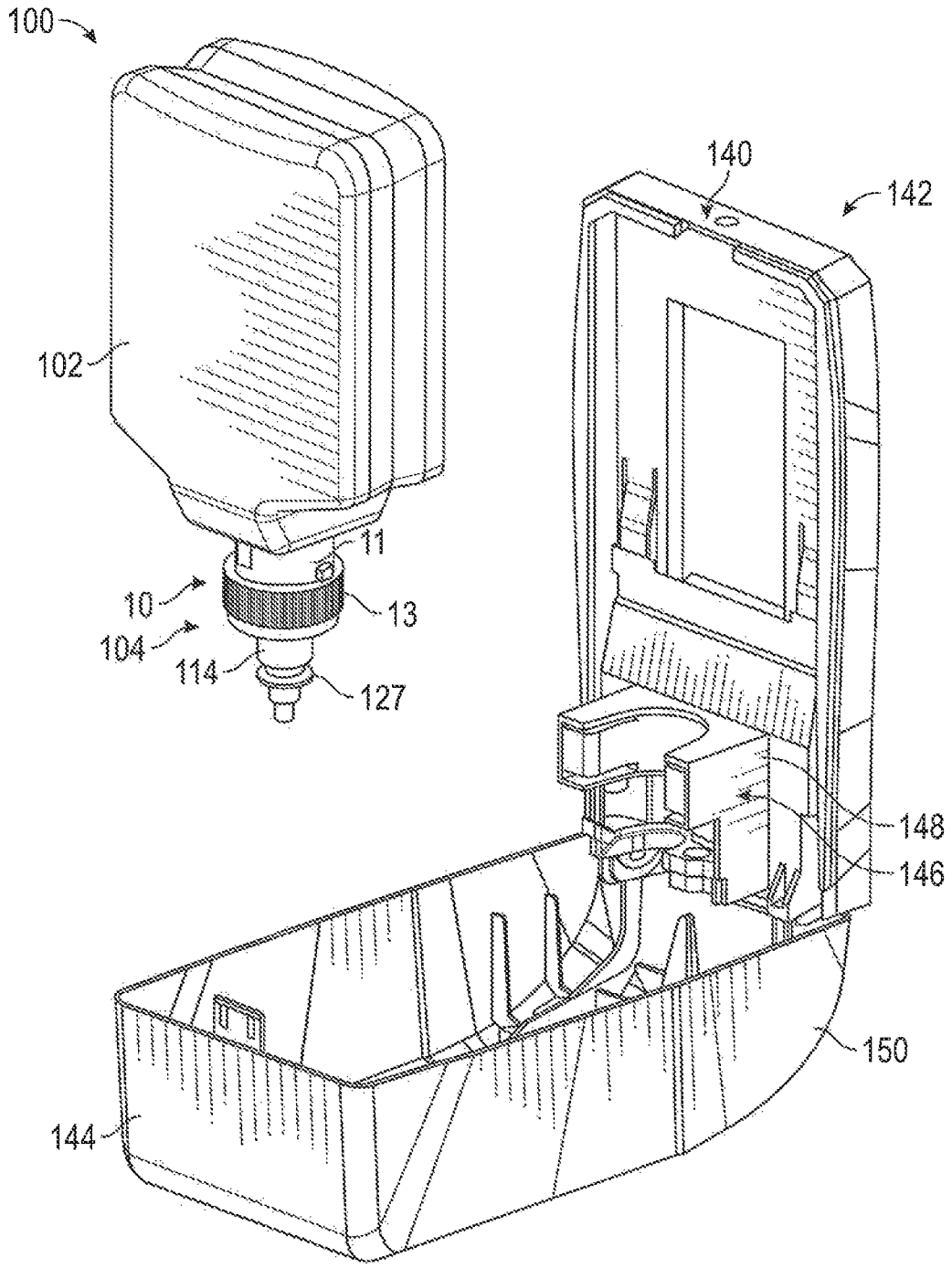
FIG. 19 is a schematic exploded perspective view illustrating a cartridge in accordance with a second embodiment of the present invention juxtapositioned relative to a dispenser which has a housing adapted to removably receive the cartridge and a cover in an open position relative the housing.
Figure 20:
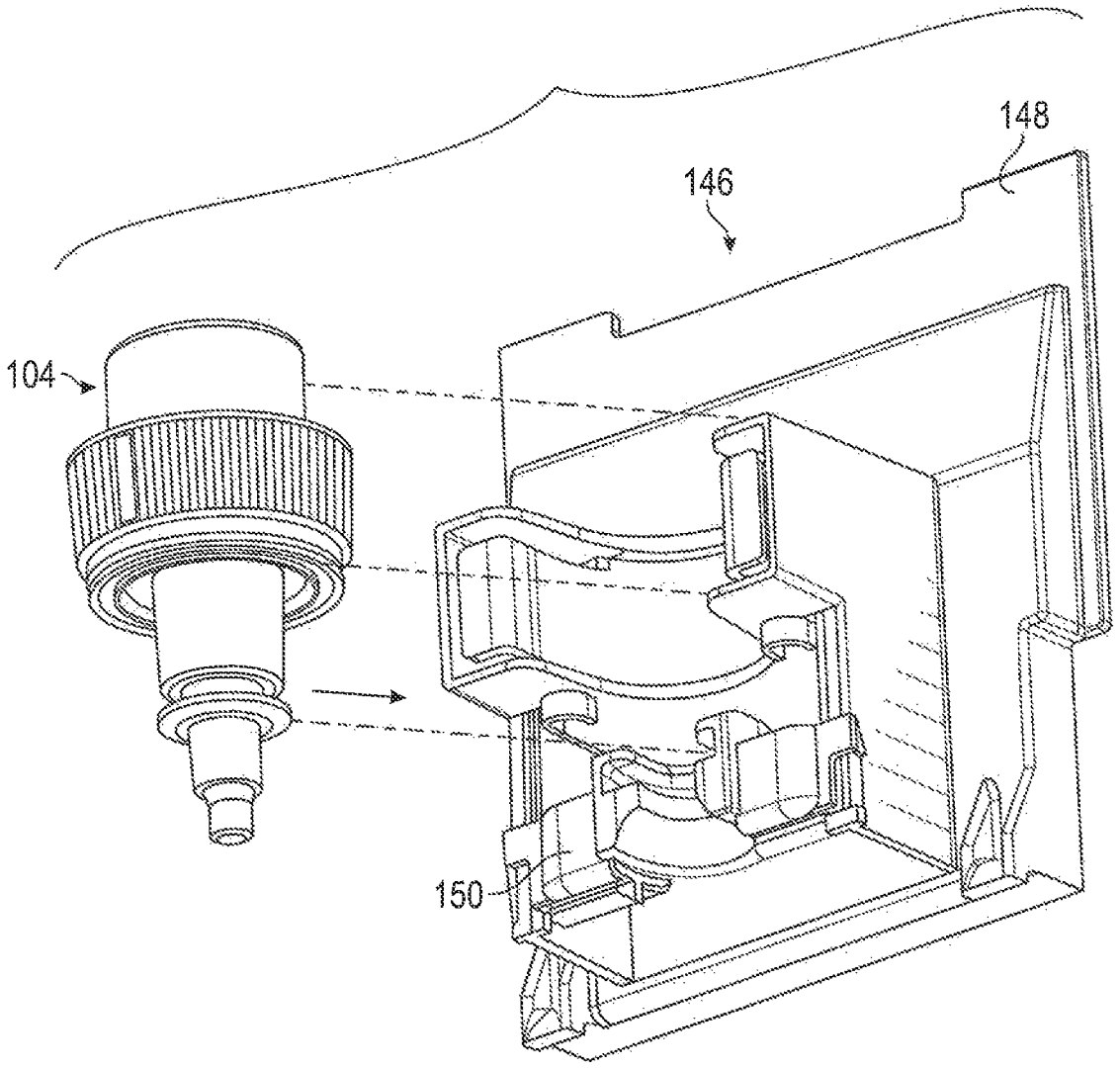
FIG. 20 is a schematic pictorial view illustrating the cap member and pump mechanism of the cartridge of FIG. 19 as aligned forwardly in front of a bottle holding mechanism of the housing of the dispenser shown in FIG. 19.
Figure 21:
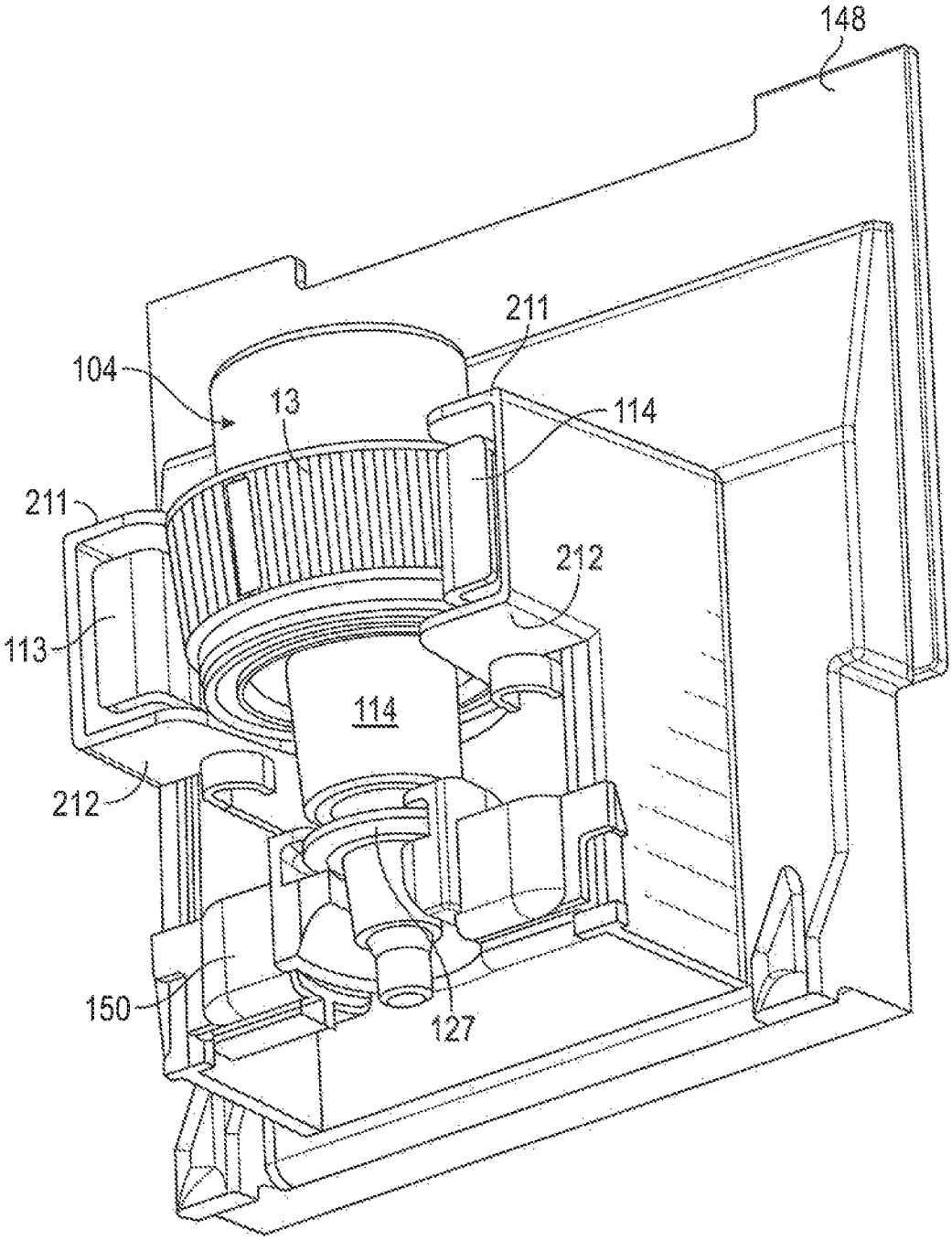
FIG. 21 is a pictorial view showing the cap member and pump mechanism of FIG. 20 as coupled to the bottle holding mechanism of FIG. 20.

Reference is made to FIGS. 19 to 21 which illustrate a second embodiment of a replaceable cartridge 100 in accordance with the present invention in which a threaded coupling arrangement 10 as described with reference to the first embodiment is provided for coupling of the collar member 13 to a threaded neck member 11 of the container 102 with a piston-forming element 114 of a pump mechanism 104 to extend outwardly from the container 102 carrying the engagement flange 127. FIG. 19 shows the container 102 in an exploded view ready for coupling to the housing 140 of a fluid dispenser 142 and showing a cover 144 for the housing 142 in an open position. FIG. 19 further shows the housing 142 as including a coupling mechanism 146 including a collar engaging structure 148 fixed to the housing 142 and an engagement flange engaging actuator 150 mounted to the collar engaging structure 148 for relative vertical sliding. FIG. 20 merely shows the pump mechanism 104 disposed in front of the coupling mechanism 146. FIG. 21 shows the pump mechanism 104 with the collar member 13 secured to the structure 148 and engaged between two vertically spaced plates 211 and 212 in a snap-fit relation between two spring-loaded side arms 113 and 114 whereby the collar member 13 and thereby the container 102 is secured to the housing 142 against movement. FIG. 21 shows the piston-forming element 114 having its engagement flange 127 engaged with the axially slidable actuator 150 for vertical sliding movement together.

FIGS. 19 to 21 illustrate an arrangement similar to that disclosed in U.S. Pat. No. 8,113,388 to Ophardt et al, issued Feb. 14, 2012, U.S. Patent Publication 2017/0337451, published Nov. 23, 2017 and U.S. Patent Publication 2015/0190827 to Ophardt et al, published Jul. 9, 2015, the disclosures of which are incorporated herein by reference.

In accordance with the threaded coupling arrangement in accordance with the present invention, the anti-rotation threading arrangement of the present invention may be provided without increasing the axial or radial extent of a collar member. Previously known cartridges include a collar member with normal continuous helical threads adapted to engage on continuous helical threads on the neck of the container. An advantage of the threaded coupling arrangement in accordance with the present invention is that a continuous conventionally threaded cap member may be engaged onto a bottle in accordance with the present invention with threads as shown in FIG. 4, albeit without any anti-rotation effect and, as well, a collar member 13 such as illustrated in FIG. 4, may be threadably engaged onto a bottle which carries a continuous normal thread without ratchet slots, again, without any anti-rotation effect. This permits both the container 102 as shown in FIG. 4 and the collar member 13 as shown in FIG. 4 to be used interchangeably with existing bottles and collar members albeit without any anti-rotation effect. Insofar as the anti-rotation effect is desired, then collar member 13 can be used with the container 102 as shown in FIG. 4 providing the anti-rotation effect and the cartridge with the collar member and container 102 of FIG. 4 is adapted for removable coupling to a dispenser housing as shown in FIGS. 19 to 21 in the same manner as a cartridge that does not have the anti-rotation features taught by the present invention.

Figure 22:
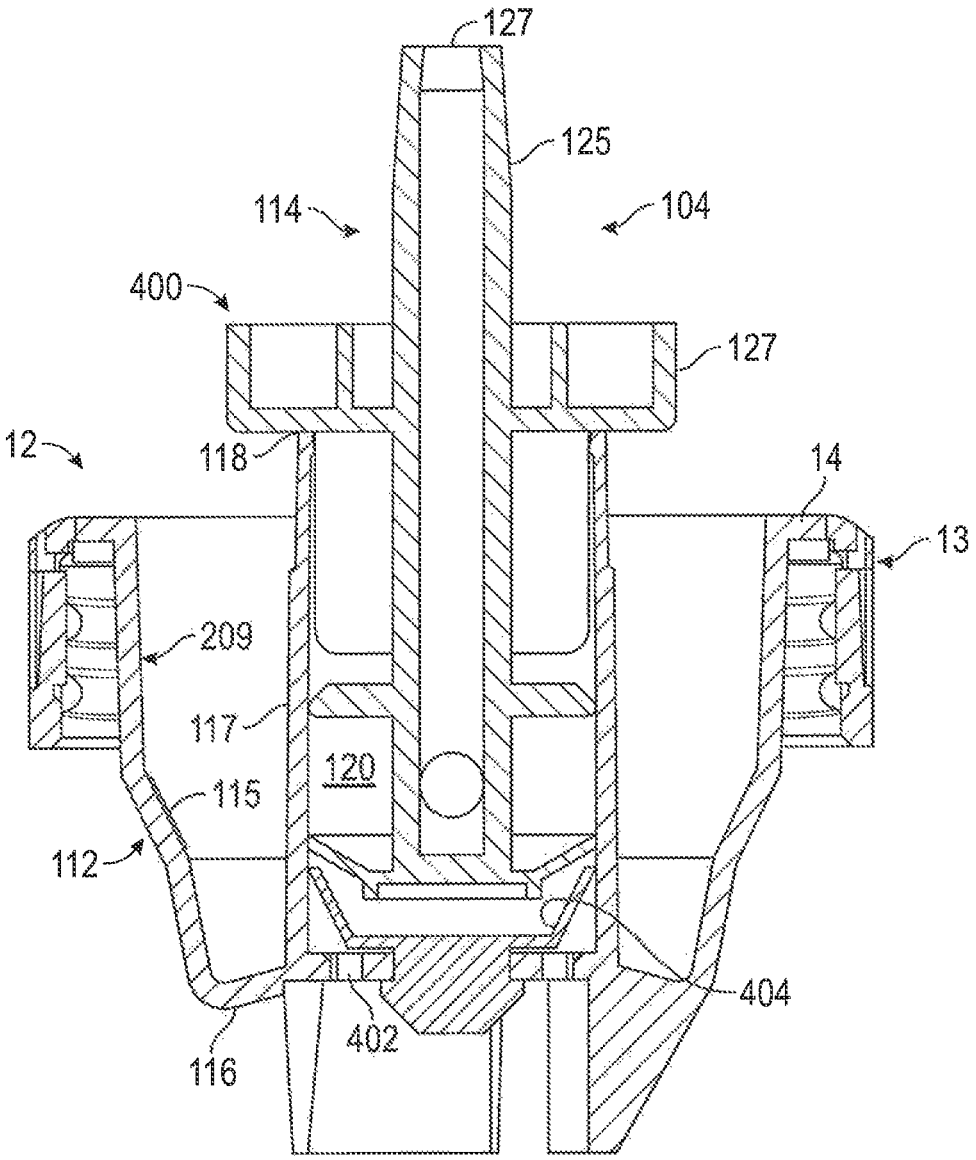
FIG. 22 is a cross-sectional front view of an alternate embodiment of a pump mechanism incorporating the collar member of FIG. 4.

Reference is made to FIG. 22 showing an alternate embodiment of a pump mechanism 104 incorporating the collar member 13 as illustrated in FIG. 4, however, incorporating a liquid piston pump 400 as disclosed in U.S. Pat.

No. 5,975,360 to Ophardt, issued Nov. 2, 1999, the disclosure of which is incorporated herein by reference. The pump mechanism of FIG. 22 can be utilized in substitution of the pump mechanism 104 shown in FIGS. 1 and 2. Similar reference numerals are used in FIG. 22 to refer to similar elements in the other embodiments.

The pump mechanism 104 includes a piston chamber-forming body 112 and a piston-forming element 114. The piston chamber-forming body 112 is formed by a cap member 12 which includes a collar member 13 having an annular ring end wall 14 from which an interior tubular structure 209 extends inwardly. The interior tubular structure 209 includes a cylindrical interior tube 115 that extends inwardly from the top annular ring wall 14 of the collar member 13 to radially inwardly extending shoulder 116 that merges with an axially outwardly extending innermost diameter tube 117 open at an upper outer end 118. The collar member 13 is identical to that shown in the embodiment of FIG. 4 and adapted to be threadably engaged onto the threaded neck member of a container in the same manner as with the embodiment of FIGS. 1 to 18.

In FIG. 22 the piston chamber-forming body 112 forms a liquid chamber 120 within the innermost tube 117, open at an inner end into the interior of a container on which the collar member 13 is to be secured via an inlet opening 402 through the shoulder 116. A one way valve 404 permits fluid to flow outwardly through the inlet opening 402 to the liquid chamber 120 but prevents fluid to flow through inwardly from the liquid chamber 120 through the inlet opening 402 to container. The piston-forming element 114 is disposed to be coaxially slidable within the piston chamber-forming body 112 to form the liquid pump within the liquid chamber 120. The piston-forming element 114 has a discharge tube 125 extending axially outwardly from the cap member 12 presenting a discharge outlet 127 via which liquid from within the container may be discharged by operation of the liquid pump. The discharge tube 126 of the piston-forming element 114 carries an engagement flange 127 axially outwardly of the cap member 12 for engagement to move the piston-forming element 114 relative to the piston chamber-forming body 112 to discharge the liquid.

Preferred embodiments illustrate the use of a threaded coupling arrangement 10 in accordance with the present invention with a cap member 12 incorporating a pump mechanism 104 which in the preferred embodiments is illustrated as a piston pump. The nature of the pump mechanism that may be provided within the cap member 12 is not limited to piston pumps and various other types of pumps need to be utilized.

The cap member 12 need not, however, incorporate any pump mechanisms. For example, as schematically illustrated on FIG. 3, as shown in dashed and dotted lines Y, the top annular ring wall 14 of the collar member 13 could extend completely across the collar member 13 thus closing the collar member 13 from any flow from the container. The collar member 13 thus could form a closure cap member to be secured onto a tubular neck to prevent removal once applied. For example, this might be useful in a container where a collar member 13 is removably secured to a threaded filling outlet and the container may have another opening or mechanism for discharge of fluid from the container. Rather than have the cap member 12 closed against fluid flow therethrough or adapted to provide a pump mechanism therein, the cap member 12 may extend axially outwardly from the annular ring end wall 14 providing, for example, a tubular member for passage of fluid. The threaded coupling arrangement 10 is not limited to use for engagement about a tubular inner member 11 on a container 102 but could be used as, for example, in coupling a first tubular member to a second tubular member against removal to provide for merely fluid flow therethrough.

In the preferred embodiment of FIG. 1, the container 102 is illustrated as being a substantially rigid container which does not collapse or resist collapsing as fluid is dispensed from the container 102. In contrast, the container 102 illustrated in FIG. 19 is intended to be a collapsible container which will collapse as fluid is discharged thereto. In the preferred embodiment of FIG. 1, the resilient gasket 119 is provided to be compressed between the collar member 13 and the neck member 11. Such a resilient gasket 119 is not necessary. Other mechanisms can be provided to provide a fluid impermeable seal if desired such as merely by suitable engagement of portions of the neck member 11 and the collar member 13.

In the course of the description of the invention, various terms such as "upwardly" and "downwardly" have been used in referring to the drawings and with reference to the orientation of the various elements in the drawings. As well, the designations "inward" and "outward" have been used typically in the context of a pump mechanism 104 in which fluid within the container 102 is to be discharged axially outwardly from the discharge outlet 125.

Referring to FIG. 7, as seen on FIG. 7, each ratchet stop surface 32 is disposed in a flat axially extending plane through the center axis 111 such as a plane indicated in dashed lines at W on FIG. 7. This is not necessary and each ratchet stop surface 32 need merely be directed in a cylindrical direction sufficient that engagement between the ratchet stop surfaces 32 and the stop fingers 70 may stop relative rotation as in a counter-clockwise direction with the preferred embodiment.

On FIG. 7, dashed lines 432 are indicated proximate four of the ratchet stop surfaces 32 indicating alternative profiles for these ratchet stop surfaces 32 which, on one hand, are adequate to be engaged by the stop fingers 70 to stop relative rotation yet, on the other hand, can facilitate the manufacture of the inner tubular member 11 by injection molding for easy release of but two mold elements each of which extends circumferentially about the inner tubular member 11 180 degrees and is adapted for removal by movement radially relative to the center axis 111 away from each other.

In the preferred embodiment illustrated in FIG. 7, twelve ratchet slots 28 are provided, each being located circumferentially spaced 30 degrees from adjacent ratchet stop surfaces 32. This is not necessary and the ratchet stop surfaces 32 may be provided circumferentially spaced at different angles from each other and with the spacing of the ratchet stop surfaces not needing to be equally spaced from each other. Similarly, in the preferred embodiments, the distal stop ends 72 of the stop fingers are circumferentially spaced 30 degrees or 60 degrees from each other. This is not necessary and various different circumferential spacings may be selected. The spacings may be the same or different between different of the stop member 70. A suitable selection of the relative number and spacing of the ratchet slots 28 and the stop fingers 70 may be selected by a person skilled in the art so as to provide for desired angular rotation of the cap member 12 on the inner tubular member 11 for engagement of different of the stop members 70 and different of the ratchet stop surfaces 32.

In the preferred embodiments, the cap member 12 is illustrated to be threadably engaged onto the inner tubular member 11 by rotation in a clockwise direction, however, this is not necessary and the various thread members could be arranged for coupling by rotation in a counter-clockwise direction.

In the preferred embodiments, the outboard thread member 22 extends circumferentially about 590 degrees about the first axis and the inboard thread member 56 extends about 450 degrees about the second axis 211. The axial extent of either the outboard thread member can be suitably varied to serve the function of interaction to secure the cap member 12 onto the inner tubular member 11 and the extent of each of the inboard thread member 56 and the outboard thread member 22 may be selected to be suitable to accomplish this purpose and may be circumferentially shorter or longer than that disclosed in the preferred embodiments.

In the preferred embodiments, a plurality of ratchet slots 28 and a plurality of stop fingers 70 are shown, however, it is to be appreciated that merely but one ratchet slot 28 and one stop finger 70 need be provided. Providing a plurality of each of the ratchet slot 28 and the stop finger 70 is preferred, however, the number of each of the ratchet slot 28 and the stop finger 70 may vary, for example, from one to a larger number. Preferably, insofar as there are but one or a lesser number of a first of the ratchet slots 28 and the stop fingers 70 compared to the other, then there will be a larger number of the other.

In the preferred embodiments as illustrated, for example, on FIG. 8, the ratchet stop surfaces 32 are disposed in a plane that extends parallel to the axis 111. This is not necessary and, for example, each of the ratchet stop surfaces 32 could be disposed to extend axially at an angle to the axis 111 such as schematically illustrated by the broken lines K and L on FIG. 8 which this relative angulation relative to the axis 111 possibly assists in engagement with the stop fingers 70 to additionally prevent disengagement. As well, the distal end 72 of each of the stop fingers 70 is shown as disposed in a plane that extends axially parallel to the axis 211. This is not necessary and the distal stop end 72 could be disposed to extend axially at an angle to the axis 211. Each stop finger 70 is also shown as, for example, in FIG. 12 to be disposed in a flat plane extends axially and through the center axis 211. This is not necessary and the distal stop end 72 need merely prevent a surface which is directed circumferentially so as to engage with the ratchet stop surfaces 32 to prevent relative rotation.

In the preferred embodiments, each of the stop fingers 70 has an axial extent sufficient that the stop finger 70 extends axially sufficiently to engage both an outer course of the inboard thread member 56 and an inner course of the inboard thread member 56 as seen, for example, with stop finger 70*a* on FIG. 17. This is not necessary and one or more stop fingers could be provided so as to merely have an axial extent that they will engage but one course of the inboard thread member 56. In the preferred embodiments, each of the ratchet slots 28 are shown as being identical. This is not necessary and various different ratchet slots may have different profiles, size, angulation, axial extent and the like without departing from the scope of the invention. Similarly, in the preferred embodiments, the stop fingers 70 are provided to be substantially identical as is believed advantageous, however, each of the stop fingers 70 may be different in respect of size, shape, profiles and the like without departing from the scope of the invention.

In the preferred embodiment illustrated in FIG. 8, ratchet slots 28 in one course shown as being axially aligned and identical to ratchet stops 28 in an adjacent course. This is not necessary and the ratchet slots 28 in one course may be different and at different axial locations than the ratchet slots 28 in another course. Having the ratchet slots to be located at identical circumferential positions has an advantage in permitting when forming as from plastic by injection molding for the mold part to be axially removable, however, this is not necessary. Similarly, the stop fingers 70 are provided in a manner which facilitates manufacture of the cap member 12 by injection molding in the preferred embodiments. However, this is not necessary and more complex and different arrangements of the stop fingers 70 as well as the internal thread member 56 may be provided without departing from the scope of the invention.

While the invention has been described with reference to preferred embodiments, many modifications and variations will now occur to persons skilled in the art. For a definition of the invention, reference is made to the following claims.

We claim:

1. A threaded coupling comprising:

an inner tubular member having a radially outwardly directed outer surface and an elongate outboard thread member, the elongate outboard thread member carried on the inner tubular member to extend radially outwardly from the outer surface, the outboard thread member extending circumferentially about the inner tubular member longitudinally from a first end to a second end along a first helix coaxial about the inner tubular member, an outer tubular member having a radially inwardly directed inner surface and an elongate inboard thread member, the elongate inboard thread member carried on the outer tubular member to extend radially inwardly from the inner surface, the inboard thread member comprising a plurality of inboard thread segments disposed end-to end spaced from adjacent of the inboard thread segments, the inboard thread member extending circumferentially about the outer tubular member greater than 360 degrees along a second helix coaxial about the outer tubular member complementary to the first helix, wherein with the inner tubular member coaxially located within the outer tubular member with the outer surface in opposition to the inner surface with the inboard thread member and the outboard thread member engaged, on relative coaxial rotation of the outer tubular member relative the inner tubular member in a coupling rotational direction engagement between inboard thread member and the outboard thread member moves the outer tubular member axially relative the inner tubular member in a coupling axial direction, the outboard thread member having an axially directed first surface and axially directed second surface directed axially away from the axialy directed first surface of the outboard thread member and merging with the first surface of the outboard thread member via a radially outwardly directed distal surface, the outboard thread member having a plurality of ratchet slots circumferentially spaced from adjacent of the ratchet slots along the outboard thread member, each ratchet slot extending radially inwardly from the distal surface of the outboard thread member axially between the first surface of the outboard thread member and the second surface of the outboard thread member and circumferentially between a first circumferential end of the ratchet slot and a second circumferential end of the ratchet slot, a tangentially directed ratchet stop surface provided at the first circumferential end of each ratchet slot, the inboard thread member having an axially directed first surface and axially directed second surface directed axially away from the axially directed first surface of the inboard thread member and merging with the first surface of the inboard thread member via a radially inwardly directed distal surface, the inner surface of the outer tubular member providing a plurality of spacing gaps located between adjacent of the inboard thread segments with each spacing gap spacing adjacent of the inboard thread segments, the outer tubular member carrying a plurality of resilient stop fingers, each resilient stop finger coupled to the outer tubular member within a respective one of the spacing gaps at a first end of the resilient stop finger, each resilient stop finger extending from the first end to a distal stop end located within the respective spacing gap, each resilient stop finger in an unbiased position extending radially inwardly a greater extent than the radially inwardly directed distal surface of the inboard thread member, each resilient stop finger deflectable from the unbiased position to biased positions in which the distal stop end is displaced radially outward from the unbiased position with an inherent bias of the resilient stop finger biasing the resilient stop finger radially inwardly from the biased postions toward the unbiased position, wherein with the inboard thread member and the outboard thread member engaged with relative coaxial rotation of the outer tubular member relative the inner tubular member in the coupling rotational direction and engagement between inboard thread member and the outboard thread member, the radially outwardly directed distal surface of the outboard thread member engages each resilient stop finger to deflect the resilient stop finger from the unbiased position to biased positions until the relative rotation brings the resilient stop finger into one of the ratchet slots and the resilient stop finger deflects from the biased positions toward the unbiased position locating the distal stop end within the ratchet slot in opposition to the ratchet stop surface, wherein with the distal stop end of one of the resilient stop fingers located within one of the ratchet slots relative coaxial rotation of the outer tubular member and the inner tubular member in an uncoupling rotational direction opposite to the coupling rotational direction is prevented by engagement between the distal stop end of the one resilient stop finger and the ratchet stop surface of the one ratchet slot.

2. A threaded coupling as claimed in claim 1 wherein:

the outer tubular member having an axially directed stop surface, the inner tubular member having an axially directed stopping surface directed in opposition to the axially directed stop surface on the outer tubular member when the inner tubular member is coaxially located within the outer tubular member, wherein with the inner tubular member coaxially located within the outer tubular member with the outer surface in opposition to the inner surface with the inboard thread member and the outboard thread member engaged on relative coaxial rotation of the outer tubular member relative the inner tubular member in the coupling rotational direction the engagement between inboard thread member and the outboard thread member moves the outer tubular member axially relative the inner tubular member in the coupling axial direction to place the stop surface on the outer tubular member in axial engagement with the stopping surface of the inner tubular member preventing further relative movement of the inner tubular member and the outer tubular member in the coupling axial direction.

3. A threaded coupling as claimed in claim 2 wherein when the stop surface on the outer tubular member is in axial engagement with the stopping surface of the inner tubular member preventing further movement in the coupling axial direction, the distal stop end of the resilient stop finger is located within the one ratchet slot with the distal end of the one resilient stop finger in opposition to the ratchet stop surface.

4. A threaded coupling as claimed in claim 3 wherein when the stop surface on the outer tubular member is in axial engagement with the stopping surface of the inner tubular member preventing further movement in the coupling axial direction, on the relative coaxial rotation of the outer tubular member relative the inner tubular member in the uncoupling rotational direction the distal end of the resilient stop finger and the ratchet stop surface are moved into engagement preventing further relative coaxial rotation of the outer tubular member and the inner tubular member in the uncoupling rotational direction.

5. A threaded coupling as claimed in claim 1 wherein:

the ratchet slot extends radially inwardly from the distal surface of the outboard thread member an extent that reduces toward the second circumferential end of the ratchet slot.

6. A threaded coupling as claimed in claim 1 wherein the ratchet slot presents the camming surface at the second circumferential end of the ratchet slot for engagement with a cam surface of the resilient stop finger to deflect the resilient stop finger to the biased positions to mow out of the ratchet slot with coaxial rotation of the outer tubular member relative the inner tubular member in the coupling rotational direction.

7. A threaded coupling as claimed in claim 6 wherein the camming surface of the ratchet slot extends radially outwardly toward the distal surface of the outboard thread member as the camming surface extends toward the second circumferential end of the ratchet slot.

8. A threaded coupling as claimed in claim 1 wherein the outer tubular member is formed as an integral member from plastic by extrusion molding, the resilient stop finger is formed between mold components with after molding one of the mold components being axially movable relative the outer tubular member away from the other mold components to release the outer tubular member.

9. A threaded coupling as claimed in claim 1 wherein:

each ratchet slot extending radially inwardly from the distal surface of the outboard thread member to intermediate the distal surface of the outboard thread member and the outer surface of the inner tubular member so as to provide along each ratchet slot a longitudinal first shoulder portion of the axially directed first surface of the outboard thread member between the outer surface of the inner tubular member and each ratchet slot; and each ratchet slot extending radially inwardly from the distal surface of the outboard thread memeber to intermediate the distal surface of the outboard thread member and the outer surface of the inner tubular member so as to provide along each ratchet slot a longitudinal second shoulder portion of the axially directed second surface of the outboard thread member between the outer surface of the inner tubular member and each ratchet slot;

wherein when the outer tubular member is coaxially located within the inner tubular member with the outer surface of the inner tubular member in opposition to the inner surface of the outboard thread member, the inboard thread member engages one of the longitudinal first shoulder portion and the longitudinal second shoulder portion to guide the inboard thread member and the outboard thread member in relative coaxial helical rotation.

10. A threaded coupling as claimed in claim 1 wherein the distal stop end of the resilient stop finger having a circumferentially directed engagement surface directed in opposition to the ratchet stop surface when the resilient stop finger is within the ratchet slot.

11. A threaded coupling as claimed in claim 10 wherein: the resilient stop finger carrying a cam surface directed circumferentially in a direction opposite to the circumferentially directed engagement surface and radially inwardly for engagement with the outboard thread member to deflect the resilient stop finger towards the biased positions on the coaxial rotation of the outer tubular member relative the inner tubular member in the coupling rotational direction.

12. A threaded coupling as claimed in claim 10 wherein the circumferentially directed engagement surface has an axial extent greater than an axial spacing of the axially directed first surface of the outboard thread member and the axially directed second surface of the outboard thread member.

13. A threaded coupling as claimed in claim 1 wherein: the resilient stop finger extending along resilient a stop finger longitudinal from the first end to the distal end, the resilient stop finger having an axial extent transverse to the longitudinal of the resilient stop finger.

14. A threaded coupling as claimed in claim 13 wherein the axial extent of the resilient stop finger transverse to the longitudinal of the resilient in stop finger is greater than an axial spacing of the axially directed first surface of the outboard thread member and the axially directed second surface of the outboard thread member.

15. A threaded coupling as claimed in claim 1 wherein the outboard thread member extending circumferentially about the inner tubular member greater than 360 degrees.

16. A threaded coupling as claimed in claim 1 wherein:

the outboard thread member extending circumferentially about the inner tubular member greater than 360 degrees with identical portions of the outboard thread member disposed axially spaced from each other as axially spaced adjacent coils of the first helix at the same circumferential positions and with identical ratchet slots axially aligned at axially corresponding locations.

17. A threaded coupling as claimed in any one of claim 16 wherein:

the inboard thread member extending circumferentially about the outer tubular member greater than 360 degrees with identical portions of the inboard thread segments of the inboard thread member disposed axially spaced from each other as axially spaced adjacent coils of the second helix at the same circumferential positions providing corresponding identical spacing gaps axially aligned at axially corresponding locations.

18. A threaded coupling as claimed in claim 17 wherein: for each corresponding identical spacing gaps axially aligned at an axially corresponding location, each resilient stop finger is provided extending along a resilient stop finger longitudinal from the first end to the distal end with an axial extent transverse to the longitudinal, wherein each resilient stop finger has the axial extent transverse to the longitudinal sufficient that the resilient stop finger extends axially through each spacing gap of the corresponding identical spacing gaps axially aligned at an axially corresponding location.

19. A threaded coupling as claimed in claim 1, wherein the outboard thread member extending circumferentially about the inner tubular member greater than 360 degrees with identical portions of the outboard thread member disposed axially spaced from each other as axially spaced adjacent coils of the first helix at the same circumferential positions and with identical ratchet skis axially aligned at axially corresponding locations, each resilient stop finger is provided extending along a resilient stop finger longitudinal from the first end to the distal end with an axial extent transverse to the longitudinal, wherein each resilient stop finger has the axial extent transverse to the longitudinal sufficient that each resilient stop finger extends axially through the identical ratchet slots axially aligned at axially corresponding locations.

20. A threaded coupling comprising:

an inner tubular member having a radially outwardly directed outer surface and an elongate outboard thread member, the elongate outboard thread member carried on the inner tubular member to extend radially outwardly from the outer surface, the outboard thread member extending circumferentially about the inner tubular member longitudinally of the outboard thread member from a first end to a second end along a first helix coaxial about the inner tubular member, an outer tubular member having a radially inwardly directed inner surface and an elongate inboard thread member, the elongate inboard thread member carried on the outer tubular member to extend radially inwardly from the inner surface, the inboard thread member extending circumferentially about the outer tubular member longitudinally of the inboard thread member from a first end to a second end along a second helix coaxial about the outer tubular member complementary to the first helix, wherein with the inner tubular member coaxially located within the outer tubular member with the outer surface in opposition to the inner surface with the outboard thread member and the inboard thread member engaged on relative coaxial rotation of the outer tubular member relative the inner tubular member in a coupling rotational direction engagement between the outboard thread member and the inboard thread member moves the outer tubular member axially relative the inner tubular member in a coupling axial direction, the outboard thread member having an axially directed first surface and axially directed second surface directed axially away from the axialy directed first surface of the outboard thread member and merging with the first surface of the outboard thread member via a radially outwardly directed distal surface, the outboard thread member having a ratchet slot extending radially inwardly from the distal surface of the outboard thread member axially between the first surface of the outboard thread member and the second surface of the outboard thread ssurface and circumferentially between a first circumferential end of the ratchet slot and a second circumferential end of the ratchet slot, a tangentially directed ratchet stop surface provided at the first circumferential end of the ratchet slot, the inboard thread member having an axially directed first surface and axially directed second surface directed axially away from the axially directed first surface of the inboard thread member and merging with the first surface of the inboard thread member via a radially inwardly directed distal surface, the inboard thread member having a spacing gap extending radially inwardly from the radially inwardly directed distal surface of the inboard thread member to the inner surface axially between the first surface of the inboard thread member and the second surface of the inboard thread member, the spacing gap circumferentially spacing the first end of the inboard thread member from the second end of the inboard thread member, the outer tubular member carrying a resilient stop finger coupled to the outer tubular member within the spacing gap at a first end of the resilient stop finger and extending from the first end of the resilient stop finger to a distal stop end located within the spacing gap, the resilient stop finger in an unbiased position extending radially inwardly beyond the radially inwardly directed distal surface the inboard thread member, the resilient stop finger deflectable from the unbiased position to biased positions in which the distal stop end is displaced radially outward from the unbiased position with an inherent bias of the resilient stop finger biasing the resilient stop finger radially inwardly from the biased positions toward the unbiased position, wherein with the inboard thread member and the outboard thread member engaged with relative coaxial rotation of the outer tubular member relative the inner tubular member in the coupling rotational direction and engagement between inboard thread member and the outboard thread member, the radially outwardly directed distal surface of the outboard thread member engages the resilient stop finger to deflect the resilient stop finger from the unbiased position to biased positions until the relative coaxial rotation brings the resilient stop finger into the ratchet slot and the resilient stop finger deflects from the biased positions toward the unbiased position locating the distal stop end of the resilient stop finger within the ratchet slot in opposition to the ratchet stop surface, wherein with the distal end the resilient stop finger located within the ratchet slot relative coaxial rotation of the outer tubular member and the inner tubular member in an uncoupling rotational direction opposite to the coupling rotational direction is prevented by engagement between the distal stop end of the resilient stop finger and the ratchet stop surface.

* * * * *